US010408467B2

(12) United States Patent
Chadwick et al.

(10) Patent No.: US 10,408,467 B2
(45) **Date of Patent: *Sep. 10, 2019**

(54) HOME COOKING APPLIANCE HAVING FLUE BOUNDARY

(71) Applicant: BSH Home Appliances Corporation, Irvine, CA (US)

(72) Inventors: Temple Chadwick, New Bern, NC (US); David Dysinger, New Bern, NC (US); Joseph Geiger, Trent Woods, NC (US); Benjamin Knight, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 448 days.

This patent is subject to a terminal disclaimer.

(21) Appl. No.: 14/205,597

(22) Filed: Mar. 12, 2014

(65) Prior Publication Data

US 2015/0260415 A1 Sep. 17, 2015

(51) Int. Cl.
*F24C 15/20* (2006.01)
*F24C 15/00* (2006.01)

(52) U.S. Cl.
CPC ..... *F24C 15/2007* (2013.01); *F24C 15/006* (2013.01); *F24C 15/2042* (2013.01)

(58) Field of Classification Search
CPC ... F24C 15/005; F24C 15/2007; F24C 15/006
USPC ..... 126/21 A, 21 R, 31, 273 R, 15 A, 15 R
See application file for complete search history.

(56) References Cited

U.S. PATENT DOCUMENTS 2,526,890 A * 10/1950 Mendel ..... F24C 3/027 126/190
3,832,988 A * 9/1974 Doner ..... F24C 15/2007 126/21 R
3,920,483 A * 11/1975 Johnson, Jr. ..... G03F 7/40 148/DIG. 131
4,763,638 A * 8/1988 Hurley ..... A21B 3/00 126/21 A
7,482,563 B2 * 1/2009 Song ..... H05B 6/6423 126/21 A
7,856,973 B2 * 12/2010 Kim ..... F24C 15/006 126/193
8,333,183 B2 * 12/2012 Nam ..... F24C 15/006 126/273 R (Continued)

*Primary Examiner* — Avinash A Savani
*Assistant Examiner* — Rabeeul I Zuberi
(74) *Attorney, Agent, or Firm* — Michael E. Tschupp; Andre Pallapies; Brandon G. Braun

(57) ABSTRACT

A home cooking appliance includes a housing, a cooking compartment in the housing, a flue in the housing and in fluid communication with the cooking compartment for exhausting flue gases from the cooking compartment, an exhaust outlet for exhausting the flue gases from the housing, and a flue boundary connecting the flue and the exhaust outlet, the flue boundary separating flue gases from cooling air flowing through the housing and preventing dilution of flue gases with cooling air. The housing includes a cooling rough-in box having a cooling air flow channel for cooling the rear wall of the flue boundary. The cooling rough-in box includes an opening permitting the cooling air to be drawn into the cooling air flow channel from an exterior of the housing by convection owing to heat on the rear wall of the flue boundary.

35 Claims, 21 Drawing Sheets

(56) References Cited

U.S. PATENT DOCUMENTS

2013/0125764 A1* 5/2013 Jeong ..... F24C 15/2035
99/357

* cited by examiner

150

100

HOME COOKING APPLIANCE HAVING FLUE BOUNDARY

CROSS-REFERENCES TO RELATED APPLICATIONS

This application is related to Applicants' co-pending U.S. applications, which are filed concurrently herewith, entitled "HOME COOKING APPLIANCE HAVING A LOW-PROFILE REAR VENT TRIM," U.S. Pat. No. 14/205,587; and "HOME COOKING APPLIANCE HAVING AN AIR CHANNEL," U.S. Pat. No. 14,205,593, each of which is incorporated herein by reference in its entirety.

FIELD OF THE INVENTION

The present invention is directed to a home cooking appliance having a flue boundary connecting a flue and an exhaust outlet of the housing, and more particularly, to a home cooking appliance having a flue boundary separating flue gases from cooling air flowing through the housing and preventing dilution of flue gases with cooling air, and more particularly, to a home cooking appliance having a flue boundary, which separates flue gases from cooling air and prevents dilution of flue gases with cooling air, and a cooling rough-in box having a cooling air flow channel for cooling the rear wall of the flue boundary.

BACKGROUND OF THE INVENTION

A conventional home cooking appliance, such as a slide-in gas range, includes a housing having a cooking compartment, such as a baking oven, convection oven, steam oven, warming drawer, etc., and a cooking surface formed, for example, by cooking grates disposed over gas burners on top of the housing. A conventional slide-in range is installed in a cooking area of a home kitchen with a rear wall of the appliance facing a back wall of the kitchen. The appliance typically is disposed between counters with floor cabinets below the counters. The kitchen may include wall cabinets mounted on the back wall of the kitchen either over the cooking surface of the range or over the adjacent floor cabinets, and/or another appliance or component, such as an over-the-range (OTR) microwave oven or an OTR convection microwave oven over the cooking surface. Industry standards and regulations commonly dictate acceptable temperatures of the combustible back wall behind the appliance, acceptable temperatures of cabinets or components over the range or adjacent to the range, as well as acceptable door temperatures for the appliance, during high temperature events, such as during a self-cleaning cycle of the oven while all burners on the cooktop are on a highest heat setting.

The appliance must exhaust the flue gases from the cooking compartment to maintain safe temperatures, acceptable combustion, etc. within the cooking compartment. Conventional appliances include various structures and techniques designed to manage and dissipate the hot air being exhausted from the appliance while complying with industry standards and regulations. In order to provide enough air flow through the appliance to maintain acceptable surface temperatures and oven door temperatures, and to protect all components, some conventional appliances include costly designs and door construction that increases the air flow through the door and/or include raised vent trims with greater air flow and louder fans. However, these designs can result in increased manufacturing costs and increased fan noise for the user.

For example, some conventional appliances manage the hot air using dilution flues, which allow cool air to flow into the flue and mix with the flue gases before exiting the flue in order to reduce outlet temperatures and protect the flue outlet and other components from unacceptable heat. However, a conventional dilution flue typically requires a large amount of space in the housing of the appliance, and requires special tooling and expensive components, resulting in increased manufacturing costs.

Additionally, conventional home cooking appliances may require a rear wall of the appliance to be spaced from the combustible back wall by a certain amount of clearance in order to manage and dissipate hot air from the appliance in order to improve compliance with the industry standards and regulations.

Furthermore, conventional cooking appliances typically use a raised or elevated exhaust vent at a rear of the appliance that exhausts flue gases upward from the housing in a vertical direction (i.e., at a 90° angle with respect to with respect to the surface of the cooktop or cooking grates), for example, to try to keep the hot flue gases from blowing on a user of the appliance and also to avoid the flue gases interfering with the operation of the gas burners. Conventional home cooking appliances typically require the rear vent trim to be a certain height above the cooking surface in order to exhaust the hot flue gas from the appliance without interfering with the operation of the burners.

For example, a conventional home cooking appliance may attempt to improve compliance with the industry standards and regulations by increasing a height of the rear vent above the cooking surface to exhaust the flue gases upward from the housing without interfering with the operation of the burners or directing the hot air toward the user. Another known manner of improving compliance with the industry standards and regulations is to increase an air flow through the appliance or an airflow exiting the appliance from the cooking compartment in order to improve compliance with the industry standards and regulations. However, an increase in the air flow through the appliance or exiting over the appliance can disrupt the performance of the burners on the cooktop, and also can result in an increase in fan noise for the user.

SUMMARY OF THE INVENTION

The present invention, as illustrated for example in the exemplary embodiments, is directed to a home cooking appliance comprising a housing, a cooking compartment in the housing and accessible through a door in a front of the housing, a flue in the housing and in fluid communication with the cooking compartment for exhausting flue gases from the cooking compartment, an exhaust outlet for exhausting the flue gases from the housing, and a flue boundary connecting the flue and the exhaust outlet, the flue boundary separating the flue gases from cooling air flowing through the housing and preventing dilution of the flue gases with the cooling air. In another exemplary embodiment, a home cooking appliance further comprises a cooling rough-in box at a rear of the housing, the cooling rough-in box having a cooling air flow channel extending along a rear wall of the flue boundary for cooling the rear wall of the flue boundary, wherein the cooling rough-in box includes a surface having an opening permitting the cooling air to be drawn into the cooling air flow channel from an exterior of the housing by convection owing to heat on the rear wall of the flue boundary.

In this way, the present invention can provide a home cooking appliance that manages the hot air in and around the cooking appliance, and particularly the hot flue gas being exhausted from the cooking compartment, without large, expensive dilution flues. Particularly, the present invention reduces flue outlet temperatures, reduces back pressure on the flue outlet, improves air flow, and provides protection for components of the appliance and other kitchen components, while providing a compact design and low-profile rear vent trim that maximizes cooking area, provides a "built-in" appearance, and minimizes or eliminates a required minimum clearance between the rear wall of the appliance and a combustible back wall of the kitchen, while maintaining compliance with industry standards and regulations.

Other features and advantages of the present invention will be described below. To provide a better understanding of the invention, and for further clarification and background of the present invention, various aspects and considerations of a home cooking appliance, which have been recognized by the present invention, first will be explained in greater detail.

As explained above, some conventional home cooking appliances manage the hot air from the cooking compartment using dilution flues, which allow cool air to flow into the flue and mix with the flue gases before exiting the flue in order to reduce outlet temperatures and protect the flue outlet and other components from unacceptable heat. However, such conventional dilution flues typically require a large amount of space in the housing of the appliance, along with special tooling and expensive components, thereby resulting in increased manufacturing costs. The present invention also recognizes that the cool air which flows from a cooling fan in a conventional dilution flue can cause a back pressure on the flue outlet and restrict air flow, thereby negatively affecting combustion in the cooking cavity and increasing temperatures in and around the appliance.

The present invention deviates from the conventional designs, which use dilution flues, and instead separates the flue gases from cooling air flowing through the housing and prevents dilution of the flue gases with the cooling air using a flue boundary. In this way, the flue boundary isolates the flue gases from the cooling air such that the flue gases and the cooling air remain separate until after they are exhausted from the housing. The present invention provides a compact, flue boundary that reduces back pressure on the flue outlet and improves air flow, thereby improving combustion in the cooking compartment, reducing outlet temperatures of the flue gas, and reducing temperatures in and around the appliance.

The exemplary flue boundary provides compact protection for the flue. Without the flue boundary, the air flow from a cooling fan would cause a back pressure on the flue outlet and restrict air flow. The flue boundary also directs the flue gases forward (away from the back wall of the kitchen) and, for example, below the cooking grates. This reduces temperatures at the rear wall of the appliance and the back wall of the kitchen while providing a low profile design. As the flue gases are directed forward and away from the back wall of the kitchen, the flue boundary prevents convective heat transfer from the flue to the rear rough-in box and back wall of the kitchen, thereby resulting is minimal radiant heat transfer that allows the appliance to be installed against the back wall with minimal clearance (e.g., a 3 mm space), or no clearance at all.

The flue boundary can be configured, for example, as a box or cavity. The flue boundary can have various shapes and sizes, for example, depending on available space within the housing, the power (BTU/Hr) of the appliance, etc. For example, the flue boundary can be an oddly shaped box, for example, forming a sealed cavity having a vertical rear wall and a sloped front wall that is angled toward the rear wall. An upper portion of the vertical rear wall can include a flange that is angled toward the front wall to deflect or direct the flue gases forward and away from the back wall as the flue gas exits a rear vent trim of the appliance. The flange also can direct the flue gas under the cooking grates of the cooking surface of the appliance. For example, the flange can be disposed at an angle of 45° with respect to the vertical rear wall of the flue boundary. The flue boundary can include a lower surface or floor having an opening or cutout with flanges that mount atop the flue outlet. The flue boundary can include side walls that are arranged parallel with the flue and cooperate with the front wall, rear wall, and lower surface to form a cavity with an inlet at the opening in the lower surface and an outlet at an upper end of the cavity for exhausting the flue gases through the rear vent trim and out of the housing. As explained above, the flue boundary does not have a dilution flue and does not introduce cooling air into the flue boundary. The flue boundary protects the flue outlets and reduces heat without a dilution process. According to the present invention, the flues gases, which can reach temperatures over, for example, 800° F., are managed by the flue boundary directing the air flow forward and away from the back wall of the kitchen (e.g., forward and away from a 90° angle with respect to an upper surface of the cooking surface (e.g., cooking grates). The flue boundary can be formed, for example, from aluminized steel, such as 22 gauge aluminized steel, or other suitable materials.

The flue boundary provides a unique way of managing heat and combustion without using large, expensive dilution flues that require special tooling. The flue boundary is soft tooled and compact, and requires no cool air inlet, which reduces manufacturing costs and manufacturing constraints, while also providing more flexibility in the arrangement of the components of the appliance and manufacturing process. The flue boundary is not limited to the exemplary embodiments and a similar flue boundary can be installed atop any flue in order to provide protection for combustions and to better maintain heat transfer, and to provide a compact height and low cost design.

The home cooking appliance can include a single flue and a single flue boundary. In another embodiment, the home cooking appliance can include a dual flue arrangement including a first flue and a second flue for exhausting flue gases from the cooking compartment. In this example, a separate flue boundary can be provided for each flue. In other embodiments, a single flue boundary can be provided for two or more flues. Other arrangements also are possible, such as an appliance having greater than two flues and/or greater than two flue boundaries. The exemplary embodiment having dual flues and dual flue boundaries can improve heat distribution and balance the cooking compartment.

As explained above, conventional home cooking appliances may require a rear wall of the appliance to be spaced from the combustible back wall by a certain amount of clearance in order to manage and dissipate hot air from the appliance and to maintain a safe distance between hot surfaces of the appliance and combustible walls or components, in order to comply with the industry standards and regulations. The present invention solves these and other problems by providing a flue boundary and a cooling rough-in box at a rear of the housing that controls and manages the heat from the cooking compartment to reduce temperatures of the rear wall of the appliance (e.g., the rear wall of the cooling rough-in box) and the back wall of the kitchen, thereby minimizing or eliminating a required minimum clearance between the rear wall of the appliance and a combustible back wall of the kitchen, while maintaining compliance with industry standards and regulations. Particularly, in an exemplary embodiment, a home cooking appliance provides a cooling rough-in box at a rear of the housing that includes a cooling air flow channel extending along a rear wall of the flue boundary for cooling the rear wall of the flue boundary. The cooling rough-in box includes a surface having an opening (e.g., one or more openings or slots in a surface of the housing) permitting the cooling air to be drawn into the cooling air flow channel from an exterior of the housing by convection owing to heat on the rear wall of the flue boundary.

The present invention recognizes that the heat of the flue boundary pulls in air through convection, and takes advantage of this by providing a cooling rough-in box with one or more openings to draw in cool air over the hot surface of the flue boundary and reduce the overall heat without mixing the flue gas and cooling air. The flue boundary and cooling rough-in box provide a low cost way to reduce temperatures within a limited amount of space. In another embodiment, the air can be drawn or conveyed into the cooling rough-in box using a blower or fan. According the present invention, even though the temperature of the flue boundary walls may be heated to a high temperature by the flue gas (e.g., 800° F.), the combination of the flue boundary and cooling rough-in box can maintain a temperature of the rear wall of the cooling rough-in box within acceptable temperature limits in compliance with industry standards and regulations. As a result, the features of the present invention can minimize or eliminate a required minimum clearance between the rear wall of the appliance and a combustible back wall of the kitchen, which faces the rear wall of the appliance, while maintaining compliance with industry standards and regulations. In an exemplary embodiment, the features of the present invention enable the required minimum clearance between the rear wall of the appliance and the combustible back wall of the kitchen to be 3 mm, while maintaining compliance with industry standards and regulations. In another exemplary embodiment, the features of the present invention can eliminate any need for a required clearance between the rear wall of the appliance and the combustible back wall of the kitchen, thereby permitting the rear wall of the appliance to directly abut or contact the combustible back wall of the kitchen, while maintaining compliance with industry standards and regulations.

As will be explained in greater detail below, the flue boundary provides an additional advantage of allowing the separate flue gases and cooling air to be used for additional heat management and control as they are exhausted from a rear vent trim of the appliance, thereby further minimizing temperatures on the combustible back wall of the kitchen and improving compliance with industry standards and regulations, and providing a low profile, rear vent trim that is substantially flush with cooking grates of the home cooking appliance. Particularly, the flue boundary and cooling rough-in box can be combined with a rear vent trim to further reduce temperatures. For example, one or more of the flue boundary, the cooling rough-in box, and a rear vent trim can be configured to direct the flow of air exiting the housing from the rear vent trim forward and away from a combustible back wall of the kitchen while simultaneously reducing turbulence above the cooking surface, thereby minimizing temperatures on the combustible back wall of the kitchen, while also maintaining passing combustion results at the gas burners and the cooking compartment. These features provide additional advantages of minimizing noise to the user and providing a low profile, rear vent trim that is substantially flush with cooking grates of the home cooking appliance. In an example, the structure for directing the flue gas can be formed by the flue boundary and concealed from view by the low-profile rear vent trim. Similarly, the structure for directing the cooling air can be formed by the cooling rough-in box and concealed from view by the low-profile rear vent trim. In other embodiments, the rear vent trim can include structure, such as a diverter, for directing the flue gas and/or the cooling air from the flue boundary and/or the cooling rough-in box, respectively. The diverter can be concealed from view from above the appliance by the low-profile rear vent trim.

In order to provide enough air flow through the appliance to maintain acceptable surface temperatures and oven door temperatures and to protect components, some conventional appliances include costly designs and door construction that increases the air flow through the door and/or include raised vent trims with greater air flow and louder fans. The conventional raised or elevated exhaust vent at the rear of the appliance exhausts flue gases upward from the housing in a vertical direction (i.e., at a 90° angle with respect to the surface of the cooktop or cooking grates), for example, to try to keep the hot flue gases from blowing on a user of the appliance and also to avoid the flue gases interfering with the operation of the gas burners. However, these designs can result in an increase in manufacturing costs as well as an increase in fan noise perceived by the user, which is a common complaint among consumers of conventional appliances.

Moreover, the present invention recognizes that a combination of factors, such as the rear vents being located at the rear of the cooking appliance away from the user, a low pressure at a surface of the back wall of the kitchen located behind the appliance, convective heat transfer from flue gases to the back wall of the kitchen, and the heated air exiting the rear vents in a vertical direction, can result in an increase in temperatures at areas of the back wall of the kitchen located behind the appliance, as well as at areas of other components that are adjacent to the appliance, such as wall-mounted kitchen cabinetry, other appliances such as an over-the-range (OTR) microwave. During operation of the appliance, cool air naturally flows in from the front of the range (from the kitchen). The hot air from the burners and oven naturally collect at the back wall, and particularly at a center of the back wall above the range, for example, due to factors such as, for example, a low pressure at a surface of the back wall and convective heat transfer from flue gases to the back wall of the kitchen. The present invention recognizes that if the air-flow is not controlled or optimized, this hot air may increase temperatures, and in some cases, result in damage to the combustible surfaces of the back wall or other components, such as an OTR microwave. The present invention also recognizes that, while cook top burners are in operation, the rear vent trim must also direct the cook top heat away from the back wall without negatively affecting low simmer rates. Thus, the air-flow must be managed in a way that reduces wall temperatures and component temperatures while maintaining passing combustion results at the gas burners and in the cooking compartment, while at the same time minimizing noise to the user.

The present invention solves these and other problems by providing one or more of a flue boundary, a cooling rough-in box, and a rear vent trim that control and manage the air flow by directing the flow of flue gas and/or cooling air from the rear vent trim forward and away from a combustible back wall of the kitchen while simultaneously reducing turbulence above the cooking surface, thereby minimizing temperatures on the combustible back wall of the kitchen and improving compliance with industry standards and regulations, while also maintaining passing combustion results at the gas burners and the cooking compartment, minimizing noise to the user, and providing a low profile, rear vent trim that is substantially flush with cooking grates of the home cooking appliance. The present invention deviates from the conventional designs, which increase a height of the vent above the cooking surface, and instead provides a low-profile rear vent trim that is substantially flush with the cooking surface, which provides a "built-in" appearance that it desirable by many users. Additionally, the present invention deviates from the conventional designs, which exhaust flue gases upward from the housing in a vertical direction (i.e., at a 90° angle with respect to the surface of the cooktop or cooking grates), and instead provides a flue boundary and/or a low-profile, substantially flush, rear vent trim that directs air away from a 90° angle with respect to the surface of the cooktop or cooking grates to direct the air flow from the rear vent trim forward and away from a combustible back wall of the kitchen, while simultaneously reducing turbulence above the cooking surface, and without increasing an air flow through the appliance or from the cooking compartment or increasing fan noise for the user.

The exemplary embodiments of a rear vent trim can include one or more openings for permitting air to exit from within the rear vent trim while directing the flue gas and/or cooling air away from the back wall. In an exemplary embodiment, the rear vent trim is configured to separate the cooling air and flue gases and to exhaust the separate cooling air and flue gas from different openings in the rear vent trim while directing both the cooling air and flue gas away from the back wall. In another example, the separate cooling air and flue gases are directed away from the back wall and the different streams are directed beneath the cooking grates and above the grates, respectively. For example, the rear vent trim directs the separate cooling air away from the back wall and in a direction above the cooking grates, while the flue boundary directs the flue gases away from the back wall and in a direction beneath the cooking grates. The structure for directing the flue gas can be formed by the flue boundary and concealed from view by the low-profile rear vent trim. Similarly, the structure for directing the cooling air can be formed by the cooling rough-in box and concealed from view by the low-profile rear vent trim. In other embodiments, the rear vent trim can include structure, such as a diverter, for directing the flue gas and/or the cooling air from the flue boundary and/or the cooling rough-in box, respectively. The diverter can be concealed from view from above the appliance by the low-profile rear vent trim.

In this way, the features of the present invention can manage and dissipate the hot air being exhausted from the appliance to minimize or prevent convective heat transfer from flue gases to the back wall of the kitchen. As explained above, the present invention can provide a home cooking appliance having a rear vent trim that is substantially flush with an upper surface of the rear end of the cooking surface, thereby providing a low-profile and compact appliance that provides a "built-in" appearance that is desirable to a user. The flush design maximizes an amount of cooktop cooking surface. At the same time, the present invention can provide a home cooking appliance having a flue boundary a rear vent trim that manages heat by directing the flow of air forward away from a combustible back wall of the kitchen, which faces the rear wall of the appliance, while simultaneously reducing turbulence above the cooking surface, thereby minimizing temperatures on the combustible back wall of the kitchen and improving compliance with industry standards and regulations. The home cooking appliance also can reduce temperatures on other components, such as wall cabinets mounted on the back wall of the kitchen either over the cooking surface of the home cooking appliance or over the adjacent floor cabinets, and/or on another appliance or component, such as an over-the-range (OTR) microwave oven or OTR convection microwave oven, thereby improving compliance with industry standards and regulations. Additionally, the home cooking appliance can manage and dissipate the hot air being exhausted from the appliance in a manner that contributes to a reduction in temperatures on surfaces or components of the home cooking appliance itself, such as temperatures on an oven door, thereby improving compliance with industry standards and regulations.

The features of the present invention also can manage and dissipate the hot air being exhausted from the appliance without interfering with the operation of the gas burners, thereby improving combustion at the gas burners. Particularly, the features of the present invention can increase an air flow for heat removal and dissipation without increasing the air flow over the burners, thereby avoiding interference with the operation of the burners, such as blowing out the burners. The features of the present invention also can reduce a pressure build-up around the flue outlet of the appliance, thereby avoiding interference with the operation of the flue and maintaining an acceptable combustion in the cooking compartment.

Moreover, the features of the present invention can increase an air flow for heat removal and dissipation without increasing a fan speed, and thus, without increasing fan noise.

The features of the present invention can be provided separately, or in combination with each other or in combination with other features of a home cooking appliance for managing and dissipating the hot air being exhausted from the appliance, thereby further improving compliance with industry standards and regulations.

The features of the present invention are not limited to any particular type of cooking appliance or to a cooking appliance having any particular arrangement of features. For example, one of ordinary skill in the art will recognize that the features of the present invention are not limited to a slide-in gas cooking appliance, and can include, for example, a built-in cooking appliance such as a gas range or gas oven, an electric range or oven, or another cooking appliance that will benefit from directing the flow of air forward away from a combustible back wall of the kitchen or another component, while simultaneously reducing turbulence above the cooking surface, thereby minimizing temperatures on the combustible back wall of the kitchen or another component, and improving compliance with industry standards and regulations.

For purposes of this disclosure, the term "back wall" refers to a combustible wall of a kitchen that faces a rear wall of the appliance when the appliance is in an installed position.

For purposes of this disclosure, an upper surface of the rear vent trim is substantially flush with an upper surface of the cooking surface if the upper surface of the rear vent trim is approximately level with the upper surface of the cooking surface, or for example, if at least the front edge or rear edge of the upper surface of the rear vent trim is approximately level with the upper surface of the cooking surface, or for example, if at least a part of the upper surface of the rear vent trim is approximately level with the upper surface of the cooking surface. One of ordinary skill in the art will recognize that the upper surface of the rear vent trim, or any part thereof, does not need to be exactly the same height as the upper surface of the cooking surface for the upper surface of the rear vent trim to be substantially flush with the upper surface of the cooking surface.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

Figure 1:
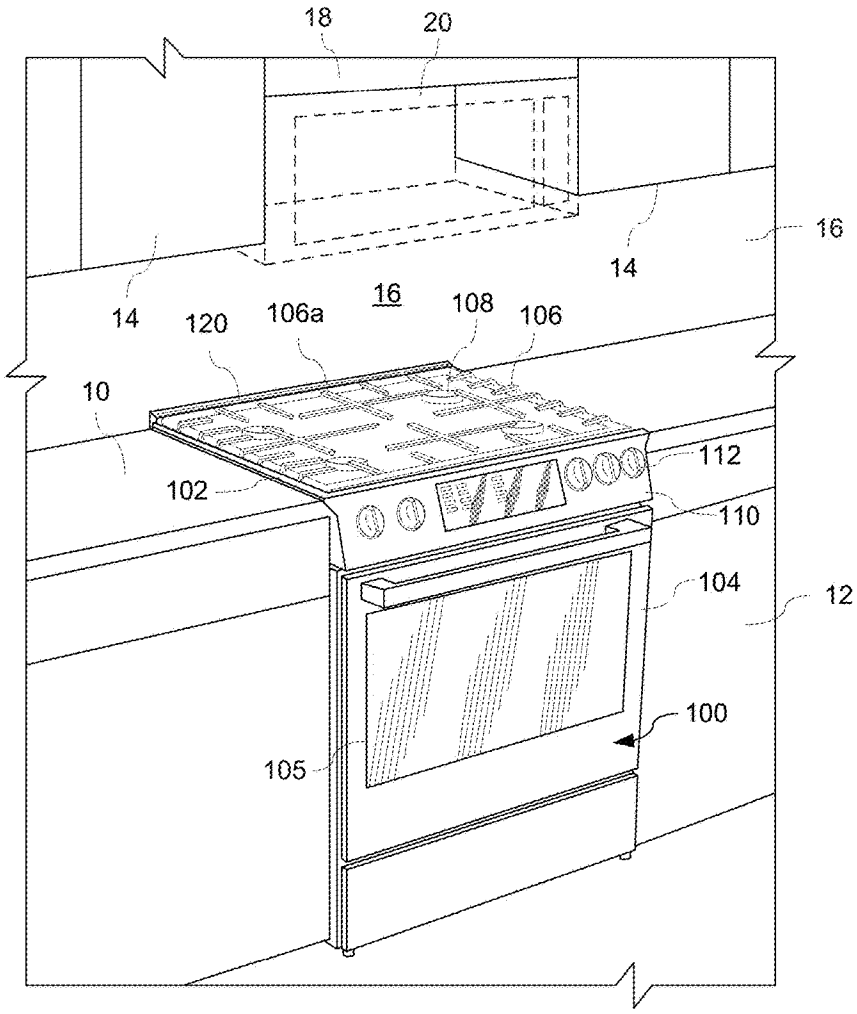
FIG. 1 is a perspective view of a home cooking appliance according to an exemplary embodiment of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1-11B illustrate exemplary embodiments of a home cooking appliance having a flue boundary and cooling rough-in box.

With reference to FIG. 1, a cooking area of a home kitchen may include counters 10 with floor cabinets 12 below the counters 10. The kitchen can include wall cabinets 14 on back wall 16 (e.g., a combustible back wall). A home cooking appliance 100, such as a slide-in home cooking appliance, can be disposed between the floor cabinets 12 and counters 10. A wall cabinet 18 or an over-the-range (OTR) microwave oven or convention microwave oven 20 can be disposed over the cooking surface 106 of the home cooking appliance 100.

With reference again to FIG. 1, an exemplary embodiment of a home cooking appliance 100 will now be described. The home cooking appliance 100 has a housing 102 with a cooking compartment, such as a baking oven, convection oven, steam oven, warming drawer, etc., in the housing 102 and accessible through a door 104 in a front of the housing 102. The door 104 has a door glass 105. The home cooking appliance 100 has a cooking surface 106 on a top of the housing 102. The cooking surface 106 can include one or more cooking grates having an upper surface 106*a* for supporting cookware over one or more gas burners 108. The appliance 100 includes a control panel 110 having a plurality of control knobs 112 for controlling the operation of the burners 108 and the cooking compartment. As shown in FIG. 1, the housing 102 can include a rear vent trim 120 on the top of the housing 102 and at a rear side of the cooking surface 106. In an exemplary embodiment, the rear vent trim 120 can include an upper surface that is substantially flush with the upper surface 106*a* of the rear end of the cooking surface 110, thereby maximizing the cooking area of the appliance and providing a low-profile appearance.

With reference to FIGS. 2A-4, an exemplary embodiment of a home cooking appliance having a flue boundary 150, cooling rough-in box 170, and a rear vent trim 120 will now be described. The cooking surface 106, the cooktop drip tray, and several of the burners 108 have been omitted in FIG. 2A to show the components that are concealed from view in an assembled state.

As shown in FIGS. 2A-4, a rear vent trim 120 is arranged at a rear side of the top of the appliance 100. The rear vent trim 120 includes a plurality of openings 128, 130, 132, and 134 for exhausting air from within the housing. The rear vent trim 120 includes openings 136 that extend along the length of the rear vent trim 120 and are arranged in fluid communication with a cavity or duct of a cooling rough-in box 170 through which cool ambient kitchen air (e.g., A1 in FIGS. 3 and 4) is drawn in via one or more entry openings 172 in a surface of the cooling rough-in box 170. In an exemplary embodiment, the present invention takes advantage of the heated walls of the flue boundary 150 (e.g., wall 152) to cause the cool ambient kitchen air A1 to be drawn in through the openings 172 by convection. In an another embodiment, the air A1 can be drawn or conveyed into the cooling rough-in box 170 using a blower or fan (not shown). In this example, the fan (not shown) can be used to draw air A1 into the cooling rough-in box 170 from any suitable location in or around the appliance 100.

Figure 2A:
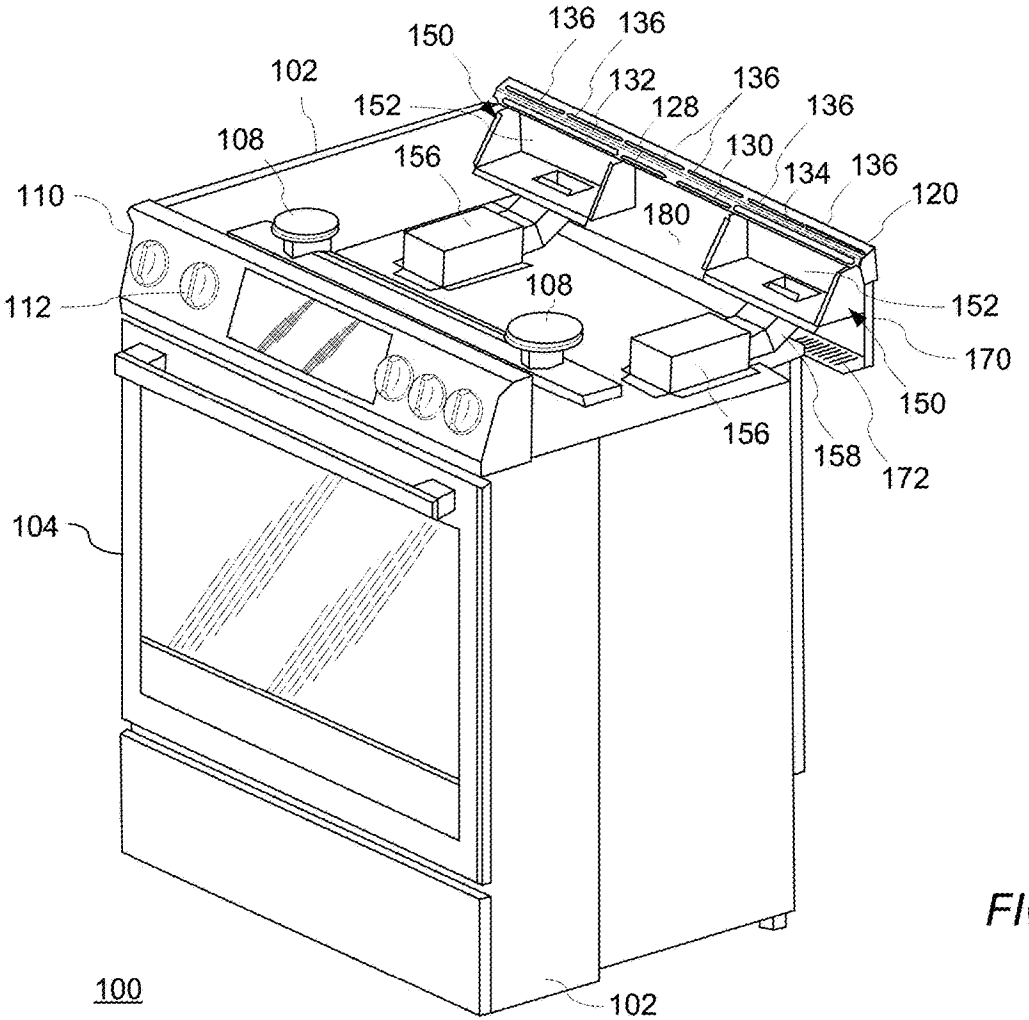
FIG. 2A is a cut-away perspective view of a home cooking appliance according to an exemplary embodiment of the invention.
Figure 2B:
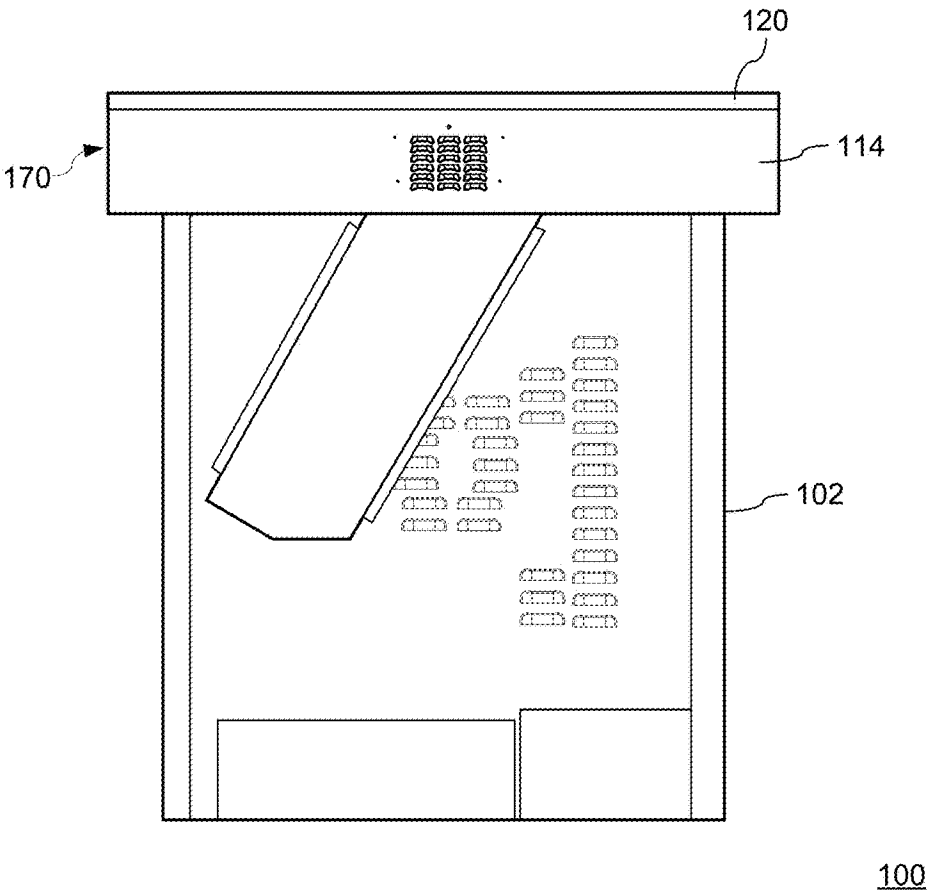
FIG. 2B is a rear view of a home cooking appliance according to an exemplary embodiment of the invention.
Figure 3:
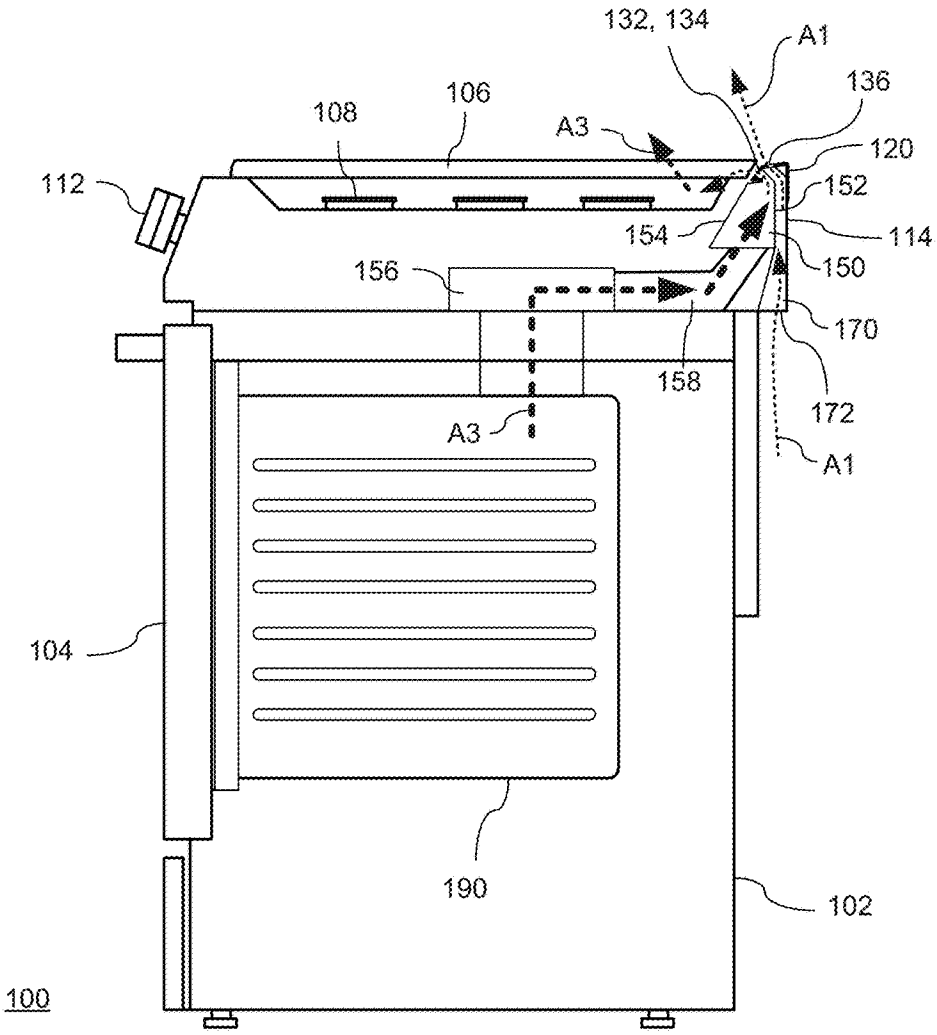
FIG. 3 is a schematic, cut-away view of a home cooking appliance according to an exemplary embodiment of the invention.
Figure 4:
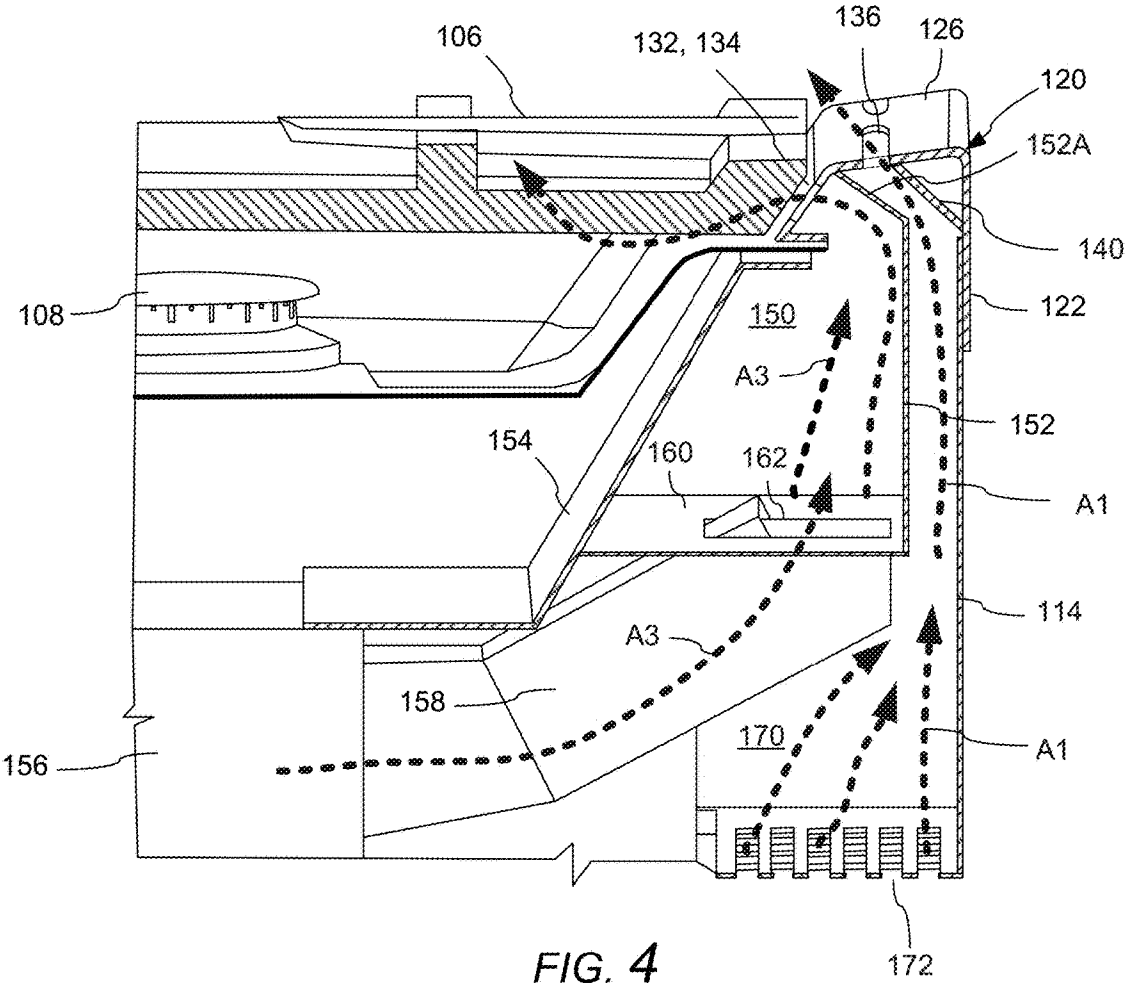
FIG. 4 is a partial perspective view of a home cooking appliance according to an exemplary embodiment of the invention.
Figure 5A:
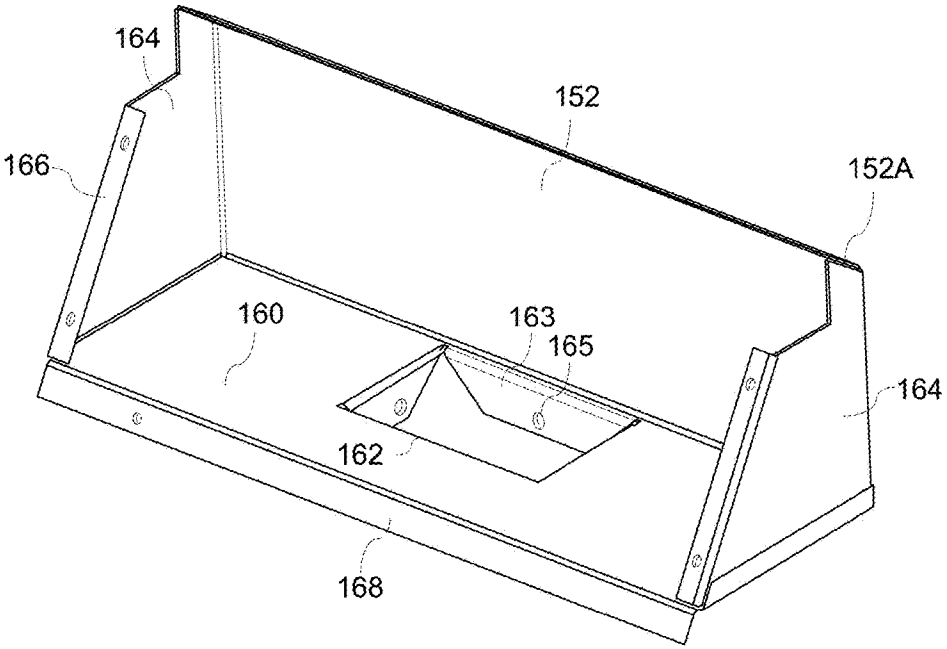
FIG. 5A is a perspective view of a flue boundary for a home cooking appliance according to an exemplary embodiment of the invention.
Figure 5B:
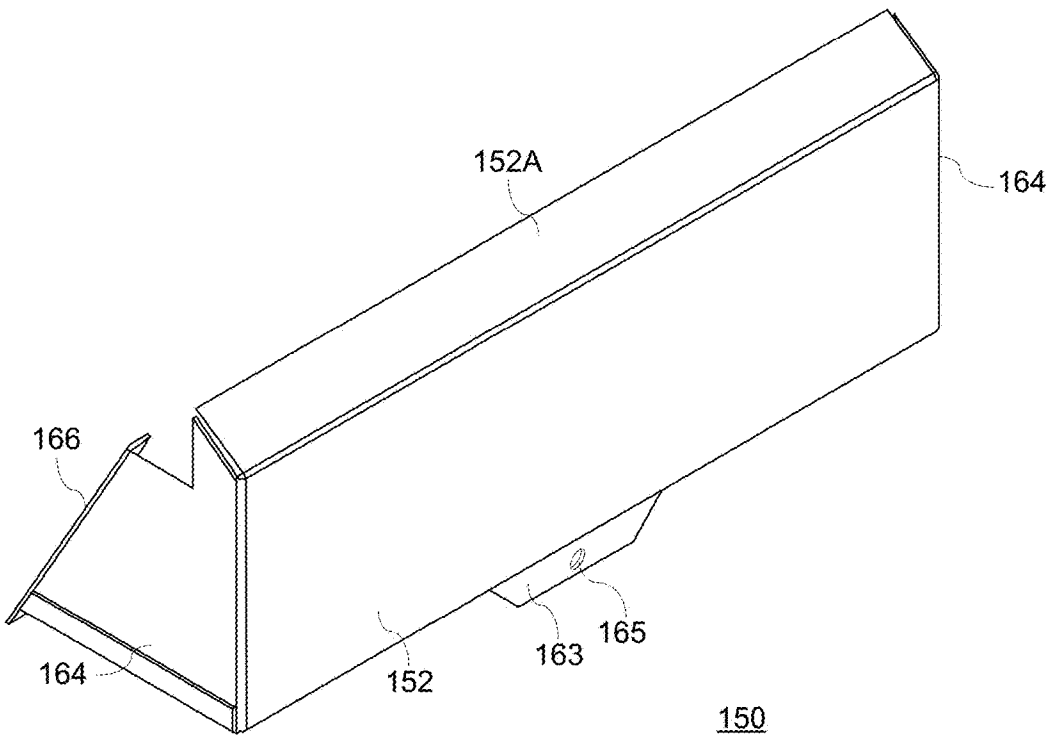
FIG. 5B is a rear perspective view of the flue boundary according to the exemplary embodiment illustrated in FIG. 5A.
Figure 5C:
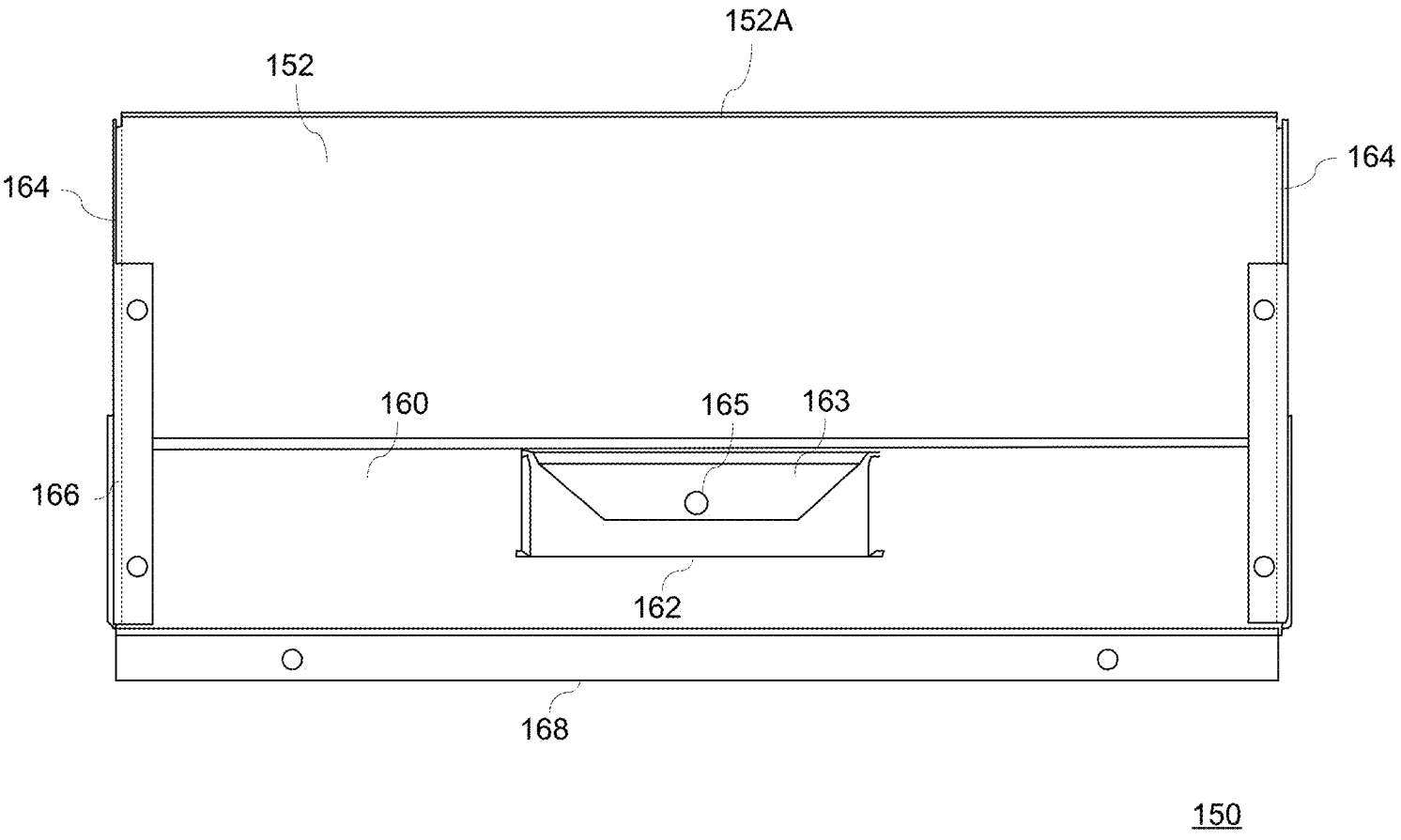
FIG. 5C is another front perspective view of the flue boundary according to the exemplary embodiment illustrated in FIG. 5A.
Figure 5D:
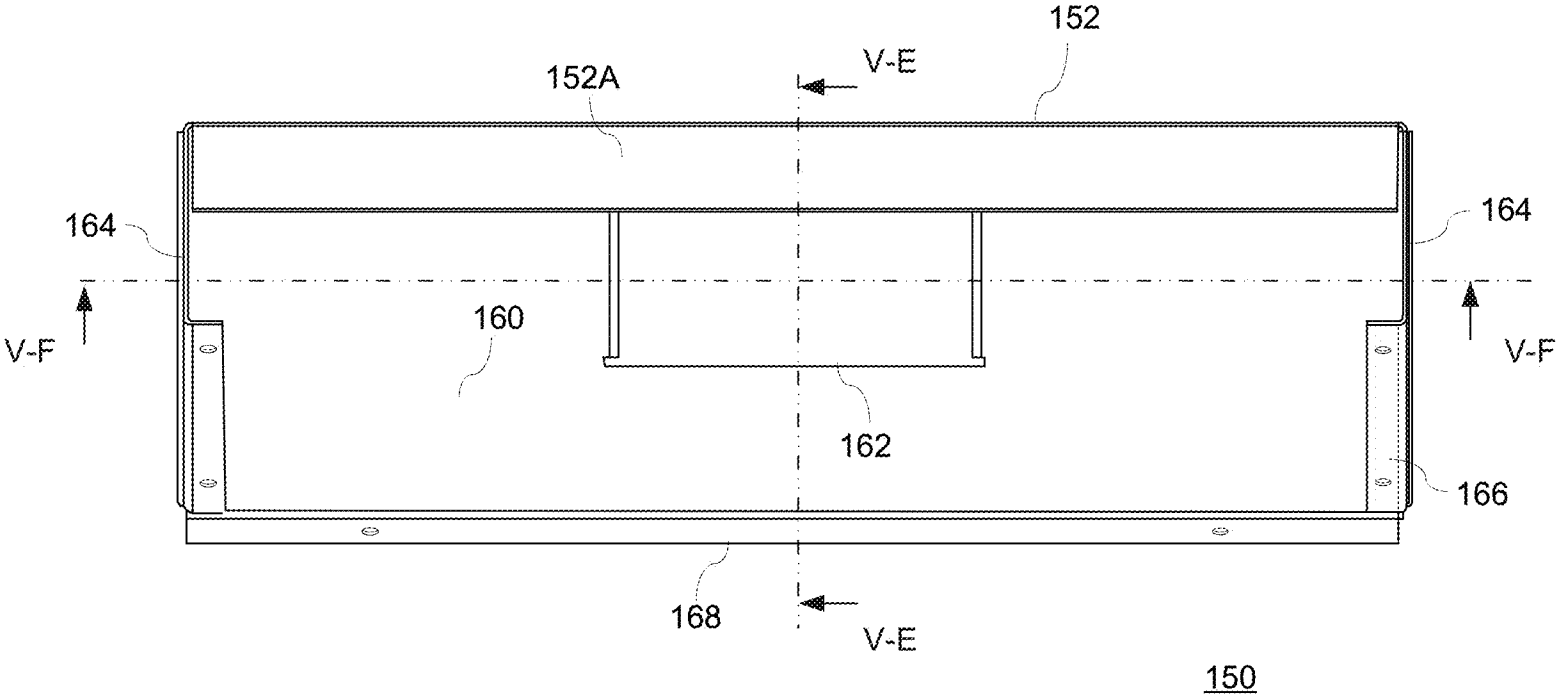
FIG. 5D is a top view of the flue boundary according to the exemplary embodiment illustrated in FIG. 5A.
Figure 5E:
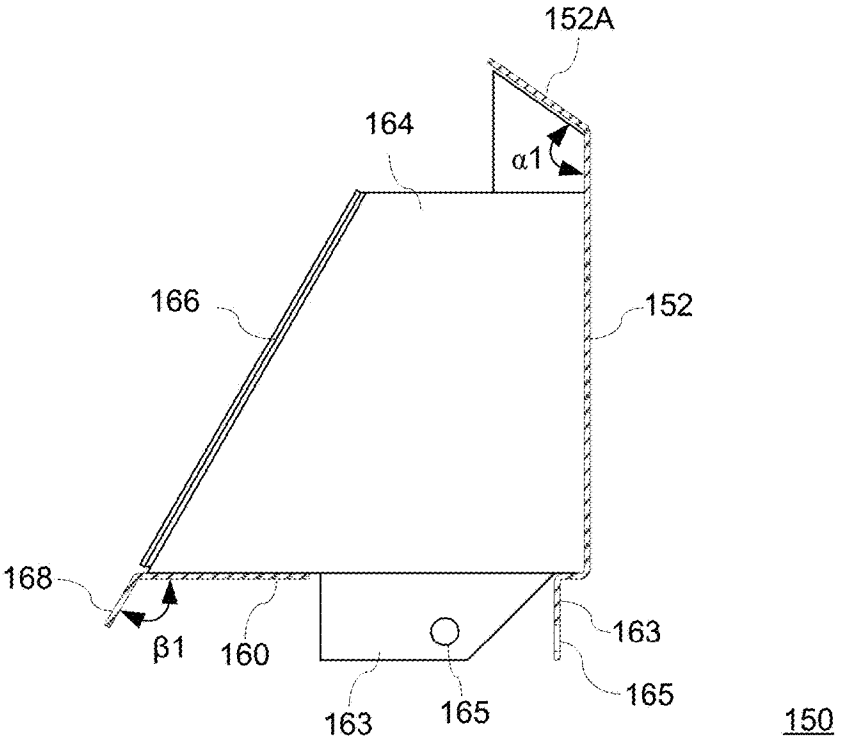
FIG. 5E is a cross-sectional view of the flue boundary according to the exemplary embodiment illustrated in FIG. 5A taken along section V-E in FIG. 5D.
Figure 5F:
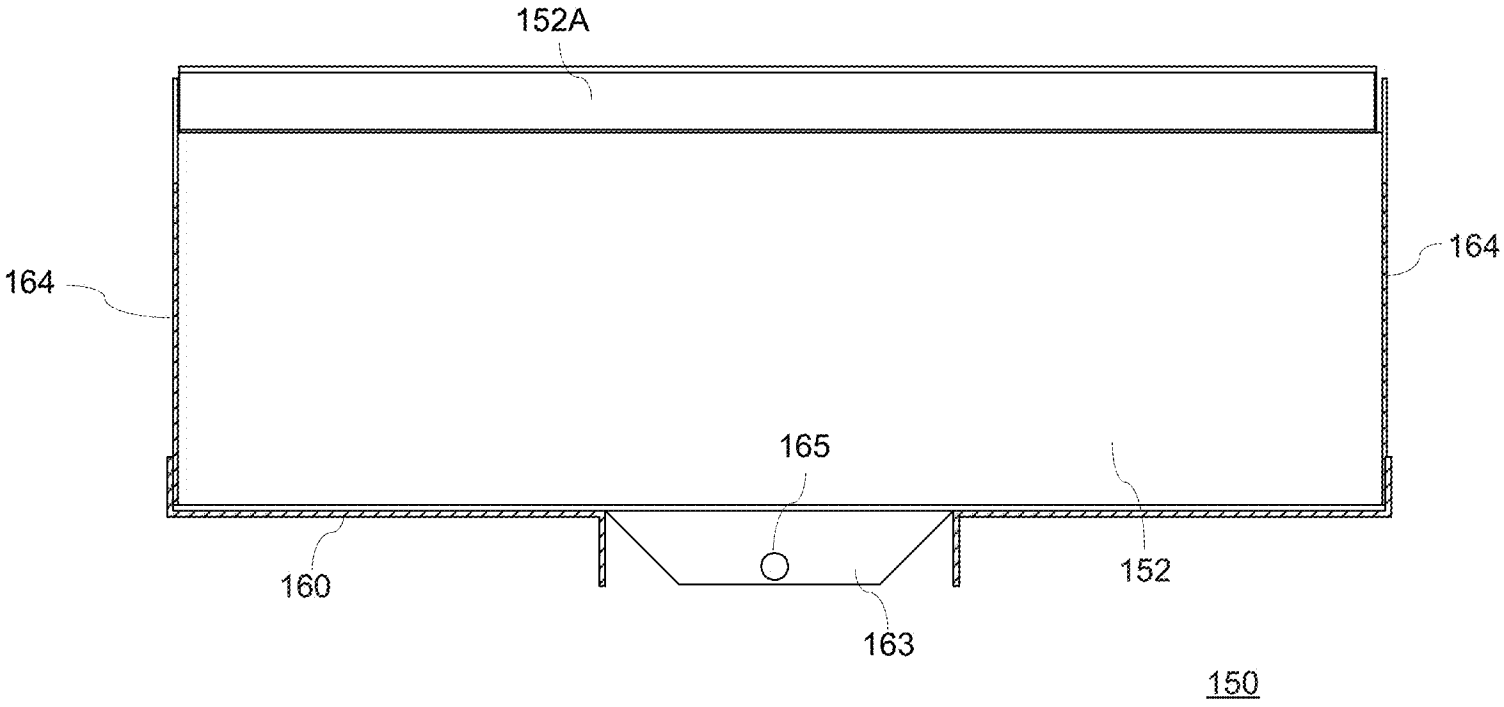
FIG. 5F is a cross-sectional view of the flue boundary according to the exemplary embodiment illustrated in FIG. 5A taken along section V-F in FIG. 5D.
Figure 5G:
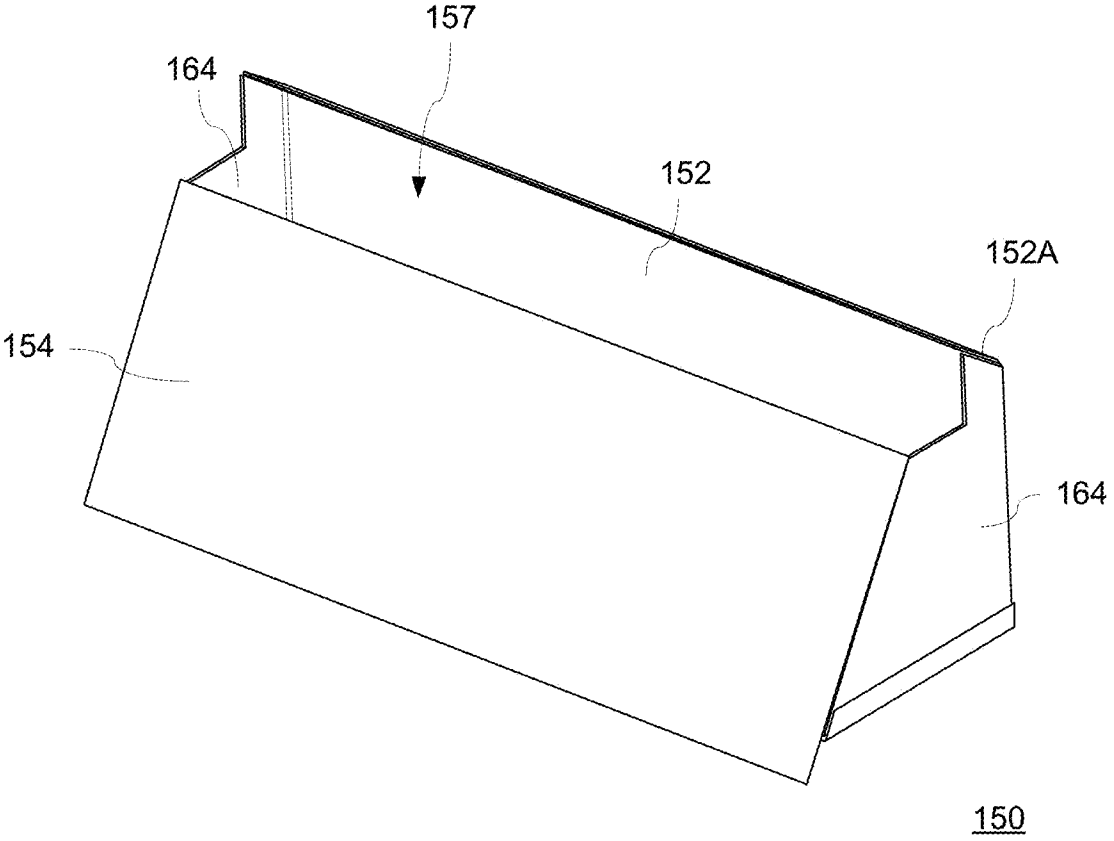
FIG. 5G is another perspective view of a flue boundary according to the exemplary embodiment illustrated in FIG. 5A including a front wall assembled in place.
Figure 6A:
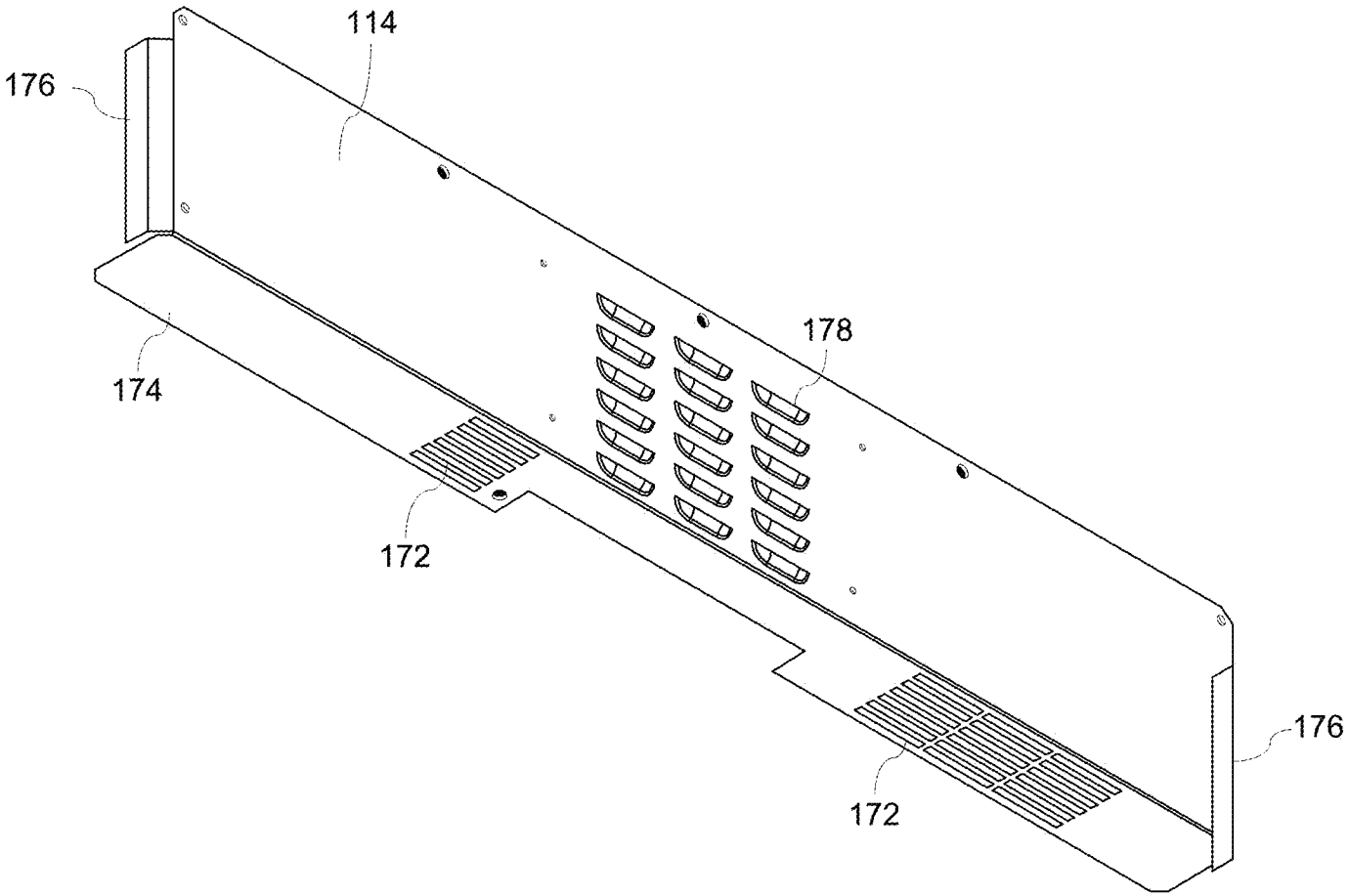
FIG. 6A is a front perspective view of a cooling rough-in box for a home cooking appliance according to an exemplary embodiment of the invention.
Figure 6B:
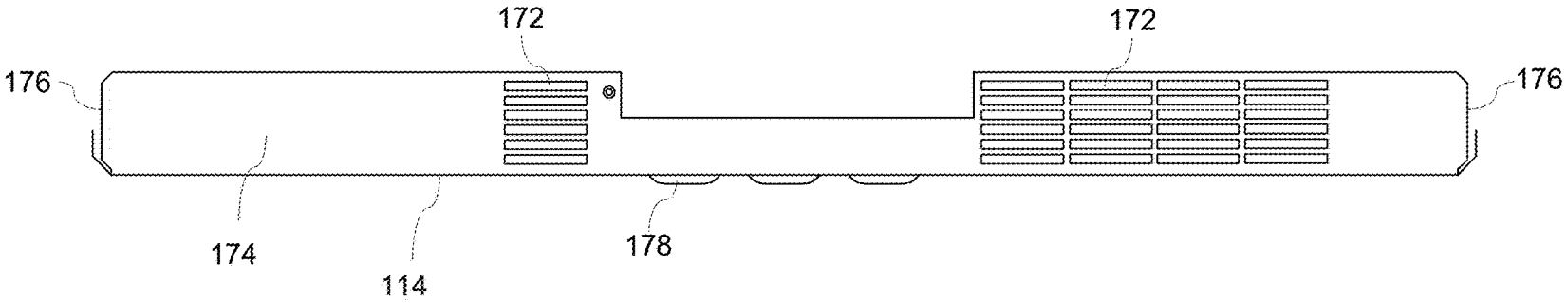
FIG. 6B is a bottom view of the cooling rough-in box according to the exemplary embodiment illustrated in FIG. 6A.
Figure 6C:
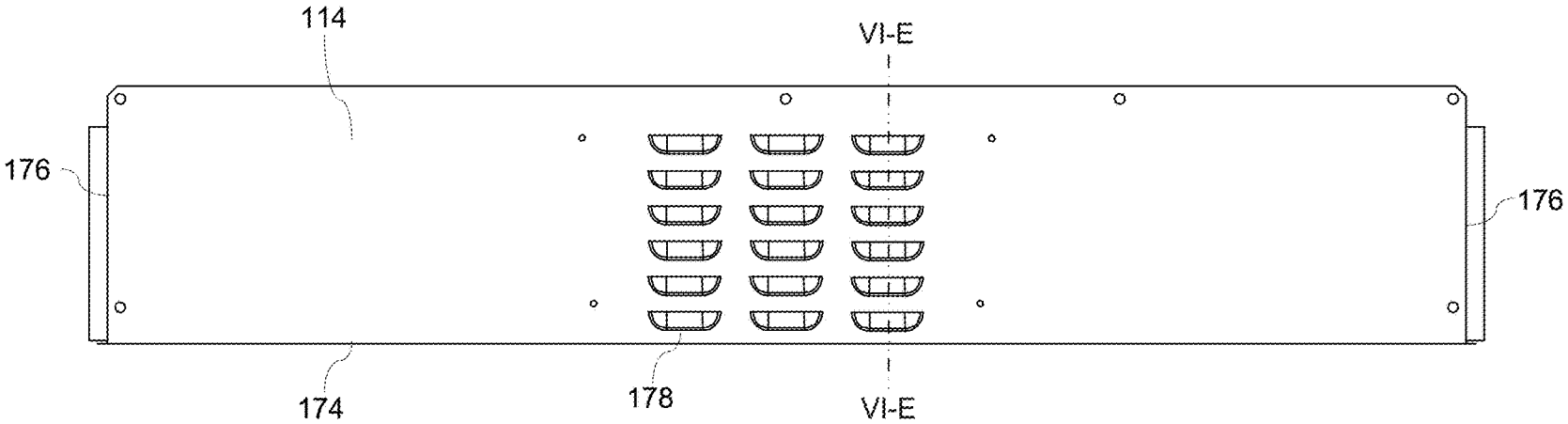
FIG. 6C is a rear view of the cooling rough-in box according to the exemplary embodiment illustrated in FIG. 6A.
Figure 6E:
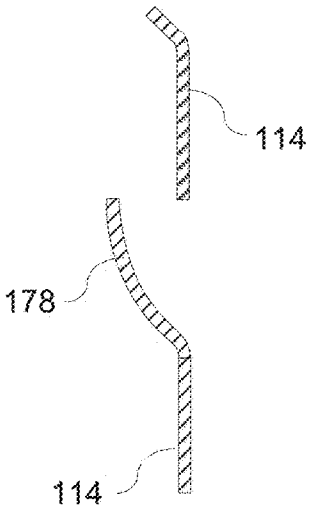
FIG. 6E is a partial cross-sectional view of the cooling rough-in box according to the exemplary embodiment illustrated in FIG. 6A taken along section VI-E in FIG. 6C.
Figure 6D:
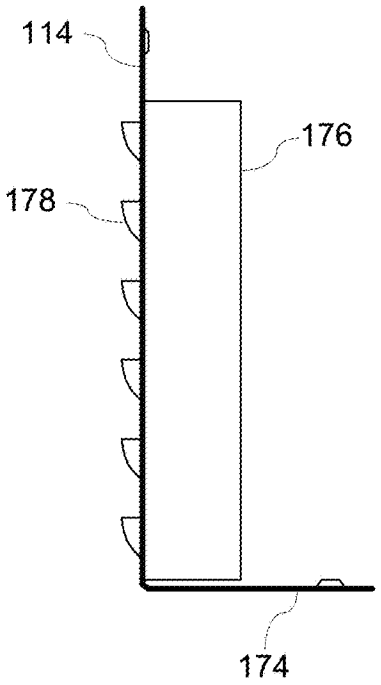
FIG. 6D is a side view of the cooling rough-in box according to the exemplary embodiment illustrated in FIG. 6A.

As shown in the example of FIGS. 2A-4, the rear vent trim 120 includes a pair of openings 132, 134 arranged at opposites ends of the rear vent trim 120 above a pair of separate flue boundaries 150, which are defined in part by walls 152, 154, and 160 (see, e.g., FIG. 4). The appliance 100 includes a pair of flues 156 for exhausting flue gases from the cooking compartment 190 (schematically shown in FIG. 3). The flues 156 are in fluid communication with ducts 158 (shown in FIGS. 2A, 3, and 4), which exit into the flue boundary 150 via openings 162 formed in the floor 160 of the flue boundary 150.

With reference again to FIGS. 2A-4, in operation, the pair of openings 132, 134 are arranged in fluid communication with the pair of separate flue boundaries 150 such that the flue gas (e.g., A3) can be exhausted from the cooking compartment 190 (shown in FIG. 3) via the openings 132, 134. As shown in FIGS. 3 and 4, the air A3 (flue gas) flows up from the flue 156 via the duct 158 into the cavity 150, where the air A3 is directed by a part of the wall 152 at an angle forward and away from a 90° angle with respect to the upper surface 106*a* of the cooking surface 106 and through the opening 132, 134 in the rear vent trim 120 in a direction, for example, under the cooking grate 106 and at an angle away from the burners 108 such that the air A3 does not disrupt the burner flame even when a burner 108 is on a lowest setting, and gently wisps out onto the cooktop spill tray on the top of the housing 102. The flue boundary 150 connects the flue 156 and the openings 132, 134 of the rear vent trim 120 and separates the flue gases A3 from cooling air (e.g., A1 and other cooling air flowing through the housing), thereby isolating the flue gas A3 from the cooling air and preventing dilution of the flue gases A3 with the cooling air A1.

As shown in FIG. 2A, the rear vent trim 120 also can include a pair of openings 130 arranged at the middle-front of the vent trim above, and in fluid communication with, a cavity or duct 180 for exhausting cooling air circulated or passed through the appliance (e.g., through the housing 102 and/or door 104 of the appliance 100) by a fan (not shown).

With reference again to FIGS. 2A-4, the home cooking appliance 100 illustrated in the exemplary embodiment has a dual flue arrangement having two flues 156 for exhausting flue gases from the cooking compartment 190. In this case, a separate flue boundary 150 is provided for each flue 156. In other embodiments, the appliance 100 can include a single flue 156 and single flue boundary 150. Alternatively, a single flue boundary 150 can be provided for two or more flues 156, or two or more flue boundaries 150 can be provided for a single flue 156. Other arrangements also are possible, such as an appliance 100 having greater than two flues 156 and/or greater than two flue boundaries 150. The exemplary embodiment having dual flues and dual flue boundaries can improve heat distribution and balance the cooking compartment. The rear vent trim 120 can include a pair of openings 132, 134, as shown in the example, or other arrangements of one or more openings arranged in fluid communication with one or more flue boundaries 150 such that the flue gas (e.g., A3) can be exhausted from the cooking compartment 190 (shown in FIG. 3).

The flue boundary 150 provides a unique way of managing heat and combustion without using large, expensive dilution flues that require special tooling. The flue boundary 150 can be soft tooled, compact, and requires no cool air inlet, which reduces manufacturing costs and manufacturing constraints, while also providing more flexibility in the arrangement of the components of the appliance and manufacturing process. The flue boundary 150 is not limited to use with the exemplary embodiments and a similar flue boundary can be installed atop any flue to provide protection for combustions in the cooking compartment and to improve heat management while providing a compact height and low cost design.

With reference to FIGS. 5A-5G, an exemplary embodiment of a flue boundary 150 will now be described. The flue boundary 150 includes a rear wall 152, a front wall (154 shown in FIG. 5G; omitted for clarity in FIGS. 5A-5F), a lower surface or bottom wall 160, and side walls 164. The flue boundary 150 can be formed, for example, from aluminized steel, such as 22 gauge aluminized steel, or other suitable materials. The flue boundary 150 is illustrated with a vertical rear wall 152, a front wall 154 (shown in FIG. 5G; omitted for clarity in FIGS. 5A-5F) being angled with respect to the rear wall 152 such that an upper portion of the front wall 154 is closer to the rear wall 152 than a lower portion of the front wall 154. However, other arrangements are possible, such as a vertical front wall 154 or an angled rear wall 152. The flue boundary 150 can include one or more flanges 166 having one or more openings for facilitating connection of the front wall 154 to the sidewalls 164 and bottom wall 160.

The flue boundary 150 includes an opening 162 configured to be coupled to the flue duct 158 or flue 156 (shown in FIGS. 2A, 3, and 4). In the example, a surface of the bottom wall 160 includes an opening 162 such that the flue boundary 150 can be disposed on top of the flue duct 158 (or flue 156). In other embodiments, the opening 162 can be formed in other locations on the blue boundary 150. The flue boundary 150 can include one or more flanges 163 having one or more openings 165 for facilitating connection to the flue duct 158. However, the flue boundary 150 can be coupled to the flue duct 158 by other suitable connection means.

The flue boundary 150 can include an outlet 157 defined by an opening or space formed by the rear wall 152, sidewalls 164, and the front wall 154. The outlet 157 can be formed in an upper part of the flue boundary 150 such that the flue boundary 150 exhausts the flue gas upwards under the rear vent trim 120 (shown in FIGS. 2A-4). The walls 152, 154, 160, and 164 of the flue boundary 150 can form a sealed cavity having an inlet (e.g., 162) and an outlet (e.g., 157).

With reference again to FIGS. 5A-5G, the rear wall 152 can include a flange or angled section 152A at an upper end of the rear wall 152. The angled section 152A can be configured to direct the flue gases forward away from a 90° angle with respect to the upper surface of the cooking surface and through the exhaust outlet in the rear vent trim 120, as shown in FIGS. 2A-4. The angled section 152A can have any suitable angle $\alpha$1 that directs the flue gas forward and away from the back wall of the kitchen. For example, the angled section 152A can be disposed at an angle $\alpha$1 of approximately 45° with respect to the rear wall 152 of the flue boundary. In other embodiments, the angled section 152A can be disposed at other angles with respect to the rear wall 152 of the flue boundary, such as greater than or less than 45° with respect to the rear wall 152. The lower section of the rear wall 152 that is disposed below the angled section 152A can be a vertical wall, as shown. However, in other embodiments, the lower section of the rear wall 152 can be angled. In other embodiments, the upper section 152A of the rear wall or the rear wall 152 can have a curved surface. However, one of ordinary skill in the art will recognize that care may need to be taken, or an additional structure provided, to prevent the flue gas from continuing to follow a corresponding curved path after exiting the openings 132, 134 in the rear vent trim 120 in order to minimize interfere with the operation of the burners.

With reference to FIGS. 6A-6E, an exemplary embodiment of a cooling rough-in box 170 (e.g., as shown in FIGS. 2A-4) will now be described.

As shown in FIGS. 6A-6E, the cooling rough-in box 170 can include a bottom wall 174, side walls 176, and a rear wall 114. In this example, the rear wall 114 of the cooling rough-in box 170 forms an exterior rear wall of the appliance, thereby minimizing space. However, in other embodiments, the exterior rear wall of the appliance can be formed separately from the rear wall 114 of the cooling rough-in box 170.

With reference again to FIGS. 6A-6E, the cooling rough-in box 170 can include one or more openings 172 for permitting air A1 (as shown in FIGS. 2A-4) to be drawn into the cooling rough-in box 170 from an exterior of the appliance 100. The openings 172 can be formed in the bottom wall 174 to permit the air A1 to be drawn by convection in an upward vertical direction of flow into the cooling rough-in box 170 (e.g., as shown in FIGS. 2A-4) with minimal obstruction or resistance. Additionally or alternatively, the openings 172 can be formed in other walls of the cooling rough-in box 170. In the illustrated example, a rear wall 114 of the cooling rough-in box 170 includes additional openings 178 for permitting air A1 to be drawn into the cooling rough-in box 170 from an exterior of the appliance 100.

With reference again to FIGS. 4 and 6A-6E, in an assembled state, the rear wall 114 of the cooling rough-in box 170 and the rear wall 152 of the flue boundary 150 cooperate to form a cooling air flow channel in fluid communication with the openings 136 of the rear vent trim 120. In this way, the cooling air A3, which is drawn in through one or more of the openings 172, 178 of the cooling rough-in box 170 (either by convection or drawn or blown by a blower), is isolated from the flue gases A3 to prevent dilution of the flue gases A3 with cooling air A1. As a result, even though the temperature of the walls (e.g., 152) of the flue boundary 150 may be heated to a high temperature by the flue gas A3 (e.g., 800° F.), the combination of the flue boundary 150 and the cooling rough-in box 170 can maintain the temperature of the rear wall 114 of the cooling rough-in box 170 (which in this case, is the rear wall of the housing 100) within acceptable temperature limits in compliance with industry standards and regulations, thereby permitting the appliance 100 to be pushed within as a little as 3 mm of clearance to the back wall 16 of the kitchen, and in some cases, pushed up against the back wall 16 of the kitchen with no clearance at all.

As explained above, the rear vent trim 120 can include a deflector 140 that directs the air A1 forward and away from a 90° angle with respect to an upper surface of the cooking surface. However, in other embodiments, the cooling rough-in box 170 can include an angled section or a deflector (not shown) that directs the air A1 forward and away from a 90° angle with respect to an upper surface of the cooking surface and through the openings 136 in the rear vent trim 120 such that the air A1 flows above the cooking surface. As a result, the heated air A1 that exits the rear vent trim 120 can be directed forward and away from the back wall 16 of the kitchen to reduce temperatures on the back wall 16 of the kitchen.

Figure 7:
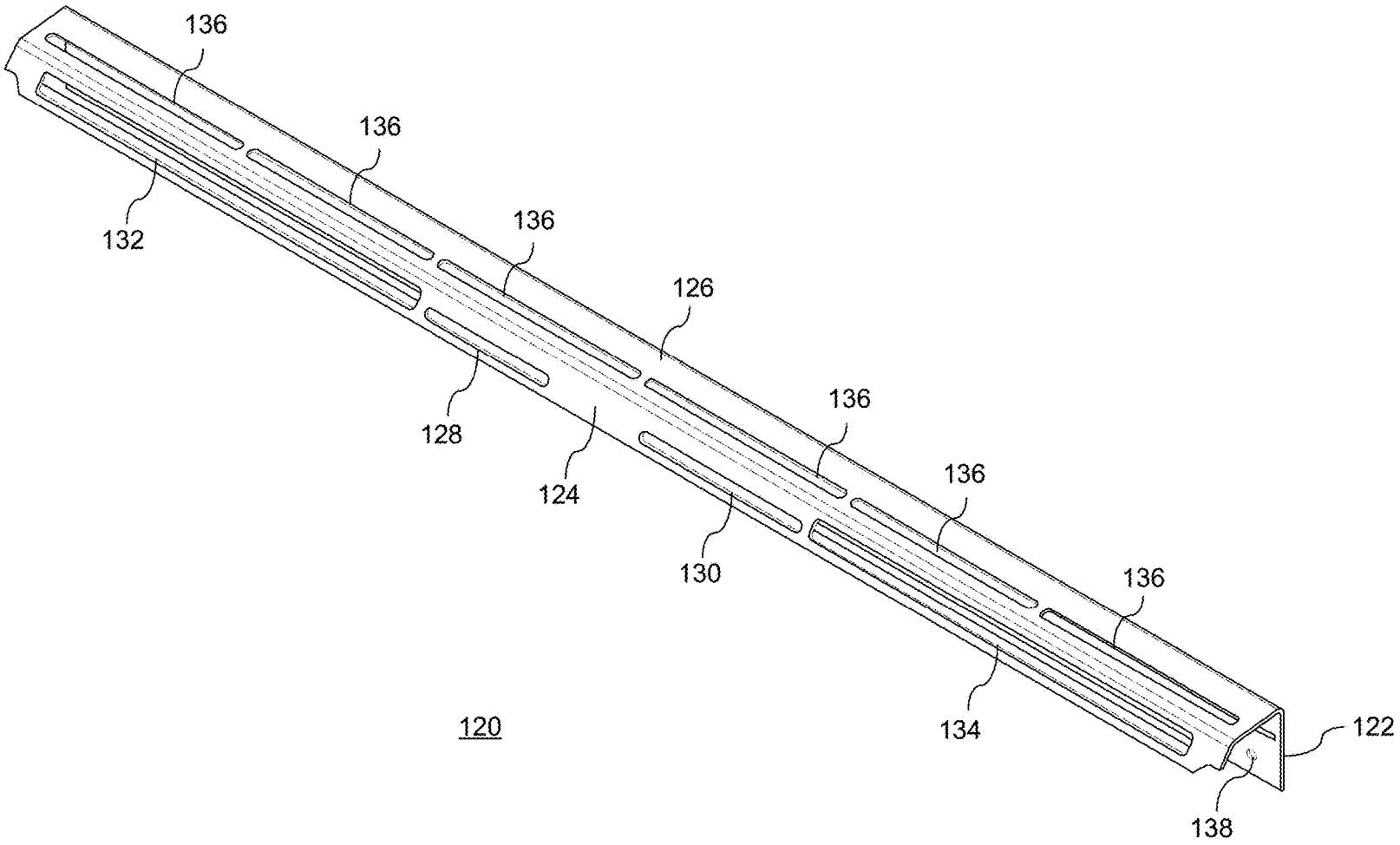
FIG. 7 is a perspective view of a rear vent trim for a home cooking appliance according to an exemplary embodiment of the invention.

FIG. 7 illustrates an exemplary embodiment of the rear vent trim 120 shown in the exemplary embodiment illustrated in FIGS. 2A-4. As shown in FIG. 7, the rear vent trim 120 includes a rear facing mounting surface 122, which is arranged to be coupled to the housing 102 of the appliance, for example, using one or more screw holes 138. In the example, the rear vent trim 120 has two upper surfaces: a first upper surface 126 and a second upper surface 124. The second upper surface 124 is arranged at an angle with respect to the first upper surface 126 and is angled by a greater amount toward a front of the appliance 100 than the first upper surface 136. In other embodiments, the rear vent trim 120 can have a single upper surface. The first upper surface 126 includes one or more openings 136 for permitting air to exit from within the rear vent trim 120. As shown in FIG. 7, the openings 136 can be different sizes in order to optimize the air flow through the openings and the resulting heat management. For example, in the illustrated example, the dimensions (e.g., the length and cross-sectional area) of several of the openings 136 vary from the others along the length of the rear vent trim 120. The dimensions of the openings 136 are not limited to the illustrated example and can have different dimensions (e.g., a different length, width, cross-sectional area, radius of curvature of the ends of the openings, etc.) in order to optimize the air flow through the openings and the resulting heat management. In other embodiments, all of the openings 136 can have the same dimensions (e.g., the same length, thickness, cross-sectional area). The openings 136 can be arranged in fluid communication with the same air source or with one or more different air sources.

With reference again to FIG. 7, the second upper surface 124 includes one or more openings 128, 130, 132, 134 for permitting air to exit from within the rear vent trim 120. As shown in FIG. 7, the openings 128, 130, 132, 134 can be different sizes in order to optimize the air flow through the openings and the resulting heat management, for example, depending on the type, temperature, and velocity of the air exiting the openings 128, 130, 132, 134. For example, in the illustrated example, the dimensions (e.g., length, width, cross-sectional area, radius of curvature of the ends of the openings, etc.) of the openings 128, 130, 132, 134 varies depending on a location along the length of the rear vent trim 120. The dimensions of the openings 128, 130, 132, 134 are not limited to the illustrated example and can have different dimensions (e.g., a different length, width, cross-sectional area, radius of curvature of the ends of the openings, etc.) in order to optimize the air flow through the openings and the resulting heat management. In other embodiments, all of the openings 128, 130, 132, 134 can have the same dimensions (e.g., the same length, width, cross-sectional area, radius of curvature of the ends of the openings, etc.). The openings 128, 130, 132, 134 can be arranged in fluid communication with the same air source or with one or more different air sources. For example, the openings 128 and 130 can be coupled to a duct conveying a cooling air through the appliance. In this example, the dimensions of the openings 128 and 130 can be different even thought they are arranged in communication with the same air source in order to optimize the air flow. In other embodiments, the dimensions of the openings 128 and 130 can be the same. Similarly, in another example, the openings 132 and 134 can be coupled to one or more flues for exhausting flue gases from the appliance. In this example, the dimensions of the openings 132 and 134 can be different even thought they are arranged in communication with the same air source in order to optimize the air flow. In other embodiments, the dimensions of the openings 132 and 134 can be the same.

With reference again to FIGS. 1, 3, 4, and 7, in order to provide a low-profile appearance and maximize the cooking area, the upper surface 126 of the rear vent trim 120 is substantially flush with the upper surface 106*a* of the cooking surface (e.g., cooking grates 106). The upper surface 126 of the rear vent trim 120 can be substantially level, and more particularly, substantially coplanar, with the upper surface 106*a* of the cooking surface 106. However, the upper surface 126 of the rear vent trim 120 does not need to be level or coplanar with the upper surface 106*a* of the cooking surface 106, as shown in FIG. 4, to be substantially flush with the upper surface 106*a* of the cooking surface 106 within the spirit and scope of the invention. For example, as shown in FIG. 4, the upper surface 126 of the rear vent trim 120 is substantially flush with the upper surface 106*a* of the cooking surface 106 if at least the front edge 126*a* of the upper surface 126 of the rear vent trim 120 is approximately level with the upper surface 106*a* of the cooking surface 106. One of ordinary skill in the art will recognize that the upper surface 126 (or the front edge 126*a* of the rear vent trim 120 or the rear edge (not labeled) of the rear vent trim 120) can be slightly higher or lower than the upper surface 106*a* of the cooking surface 106 while still providing a substantially flush arrangement having a low-profile appearance and that maximizes the cooking area of the appliance within the spirit and scope of the invention. However, the upper surface 126 of the rear vent trim 120, or any part thereof, does not need to be exactly the same height as the upper surface 106*a* of the cooking surface 106 for the upper surface 126 of the rear vent trim 120 to be substantially flush with the upper surface 106*a* of the cooking surface 106.

With reference again to FIG. 4, the upper surface 126 can be sloped or angled slightly with respect to the upper surface 106*a* of the cooking surface 106, for example, to permit the air to flow more easily away from a 90° angle with respect to the upper surface 106*a* of the cooking surface 106 as the air exits the opening 136. As shown in FIG. 4, the second upper surface 124 is arranged at an angle with respect to the first upper surface 126 and is angled by a greater degree toward a front of the appliance 100 than the first upper surface 136. In this way, the second upper surface 124 permits air to flow more easily away from a 90° angle with respect to the upper surface 106*a* of the cooking surface 106 as the air exits the openings 130, 134 (and also 128, 132), and also permits the air A3 to flow more easily under the cooking surface 106 (as shown in FIG. 4).

As shown in FIG. 4, the rear vent trim 120 can include a deflector 140 that directs the air A1 away from the 90° angle with respect to the upper surface 106*a* of the cooking surface 106 and through the opening 136 in the rear vent trim 120. The deflector 140 is arranged at an angle with respect to the vertical wall 122 of the rear vent trim 120. With reference again to FIG. 4, the air A3 flowing through the flue boundary 150 to the opening 132, 134 can be directed away from a 90° angle with respect to the upper surface 106*a* of the cooking surface 106 by a rear wall 152 of the flue boundary 150 before exiting the opening 132, 134. In another embodiment, the rear vent trim 120 can include a deflector (not shown; similar to the deflector 140), which is integrally formed with the rear vent trim 120 and which directs the air A3 away from a 90° angle with respect to the upper surface 106*a* of the cooking surface 106 and through the opening 132, 134. In yet another example, the opening 132, 134 can include a surface that directs the air A3 away from a 90° angle with respect to the upper surface 106*a* of the cooking surface 106 as the air passes through the opening 132, 134.

With reference again to FIG. 4, the opening 136 of the rear vent trim 120 can be arranged in fluid communication with the cooling rough-in box 170 for exhausting ambient kitchen air (e.g., A1) up and away from the back wall 16. The flue boundary 150 and the rear vent trim 120 control and manage the air flow above the cooking surface 106 by directing the flow of air (e.g., A1, A3) from the rear vent trim 120 forward and away from a combustible back wall 16 of the kitchen (e.g., away from a 90° angle with respect to the upper surface 106*a* of the cooking surface 106), thereby minimizing temperatures on the combustible back wall 16 of the kitchen and improving compliance with industry standards and regulations.

Figure 8:
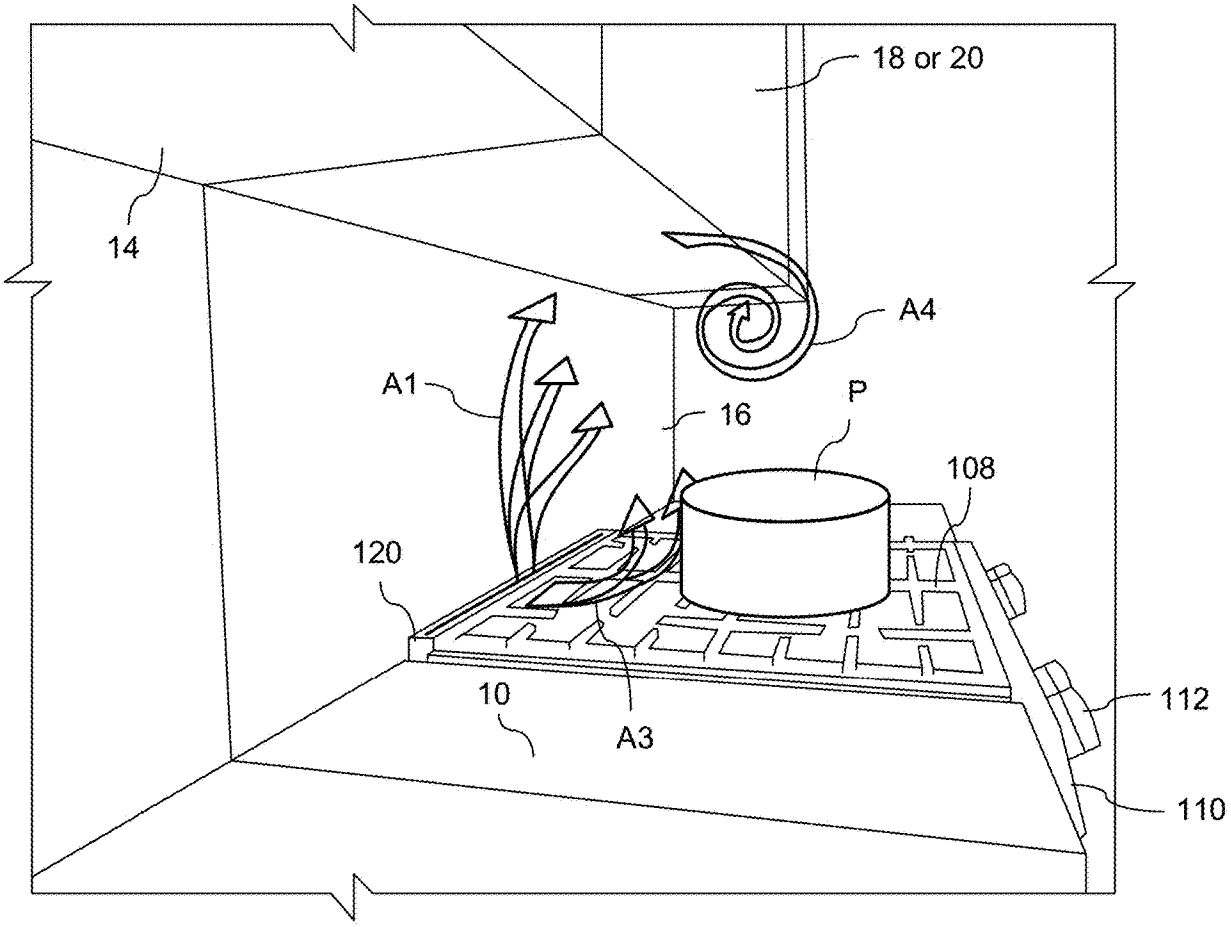
FIG. 8 is a top view of a home cooking appliance according to an exemplary embodiment of the invention.

With reference again to FIG. 4 and also to FIG. 8, the rear vent trim 120 can split the air A1, A3 such that some of the air (e.g., A3) flows at an angle forward and away from the back wall 16 and beneath the cooking grates 106, while some of the air (e.g., A1) flows at an angle forward and away from the back wall 16 and above the cooking grates 106. In operation, the air A1 is drawn into the cooling rough-in box 170 through the openings 172, flows along the rear wall 152 of the flue boundary 150, exits the rear vent trim 120 through the first opening 136 or set of openings 136, and then gently blows up and forward to cool the back wall 16 of the kitchen.

Additionally, the hot air/flue gas (oven combustion) A3 flows up from the gas cooking compartment 190 (shown in FIG. 3) through the flue 156 and flue duct 158, and into the flue boundary 150. The flue gas A3 is directed by the angled section 152A of the flue boundary 150 through the openings 132, 134 of the rear vent trim 120 in a direction under the cooking grate 106 and at an angle away from the burners 108 such that the air A3 does not disrupt the burner flame even when a burner 108 is on a lowest setting, and gently wisps out onto the cooktop spill tray on the top of the housing 102. The air A3 works in combination with the air A1 to gently spin the combined air flow A4 up in a vortex away from the back wall (16 in FIG. 8) and upper cabinets (e.g., 14, 18, 20 in FIG. 8), for example, like a reverse-Coanda effect, even in instances in which cookware (e.g., a cooking pot P) is positioned on the cooking surface 106.

Figure 9:
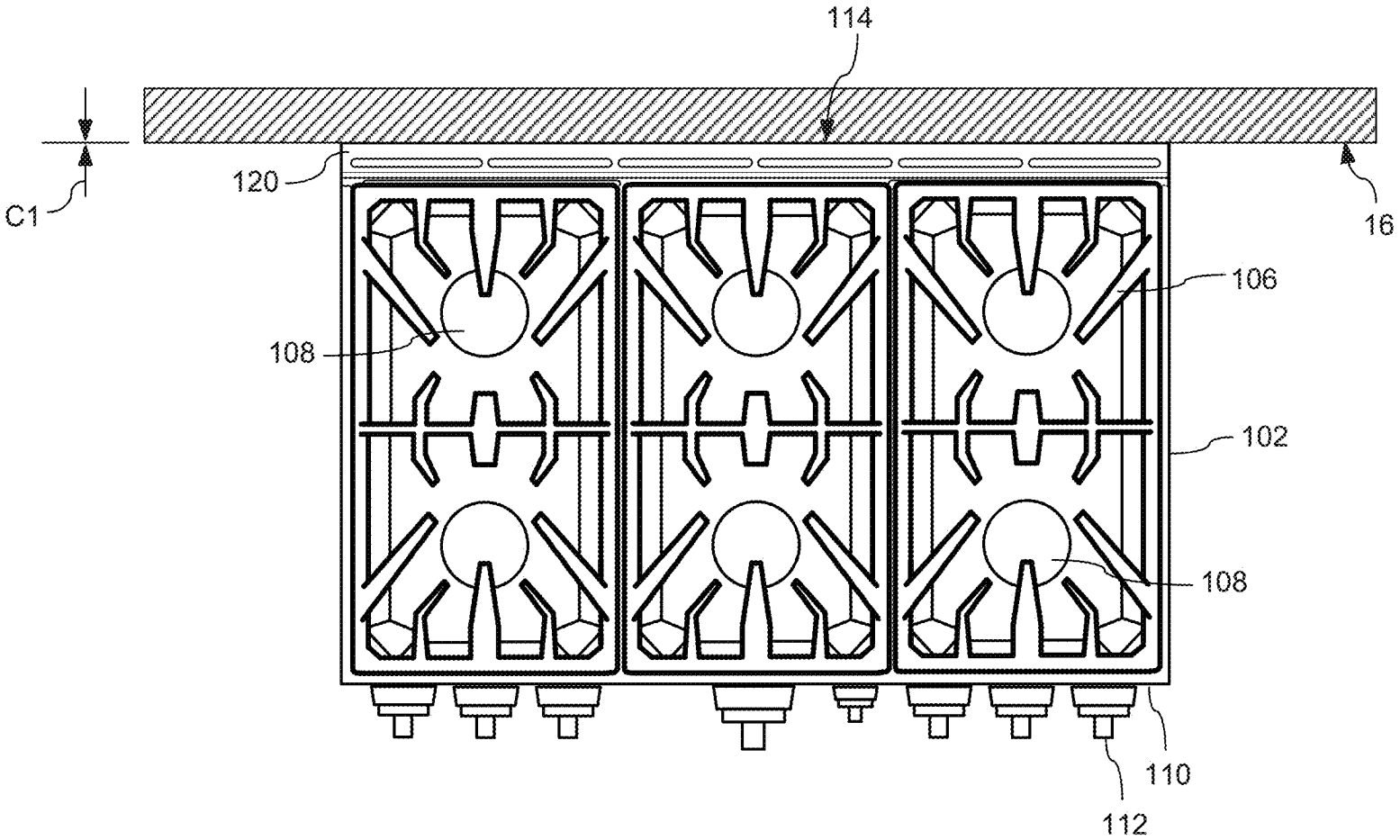
FIG. 9 is a partial, perspective view of a home cooking appliance schematically illustrating air flow patterns according to an exemplary embodiment of the invention.

With reference to FIG. 9, the flue boundary 150, cooling rough-in box 170, and/or the rear vent trim 120 control and manage the air flow above the cooking surface 106, thereby minimizing temperatures on the combustible back wall 16 of the kitchen and improving compliance with industry standards and regulations, while also maintaining passing combustion results at the gas burners 108 and the cooking compartment, minimizing noise to the user, and providing a low profile, rear vent trim 120 that is substantially flush with cooking grates 106 of the home cooking appliance 100. As a result, the present invention can minimize or eliminate a required minimum clearance C1 (shown in FIG. 9) between the rear wall 114 of the appliance 100 and a combustible back wall 16 of the kitchen, which faces the rear wall 114 of the appliance, while maintaining compliance with industry standards and regulations. In an exemplary embodiment, the flue boundary 150, the cooling rough-in box 170, and/or the rear vent trim 120 control and manage the air flow to such an extent that the required minimum clearance C1 between the rear wall 114 of the appliance and the combustible back wall 16 of the kitchen is approximately 3 mm, while maintaining compliance with industry standards and regulations. In another exemplary embodiment, the flue boundary 150, cooling rough-in box 170, and/or the rear vent trim 120 control and manage the air flow to such an extent that any need for a required clearance between the rear wall 114 of the appliance 100 and the combustible back wall 16 of the kitchen can be entirely eliminated, thereby permitting the rear wall 114 of the appliance to directly abut or contact the combustible back wall 16 of the kitchen, while maintaining compliance with industry standards and regulations.

FIGS. 10A-10D illustrate thermal imaging showing a comparison between a conventional appliance and an exemplary appliance having the features of the present invention. The thermal imaging illustrates higher temperatures using lighter shades, and illustrates lower temperatures in darker shades. The thermal imaging has been annotated to identify the features of the appliance and the surrounding environment of the kitchen.

Figure 10B:
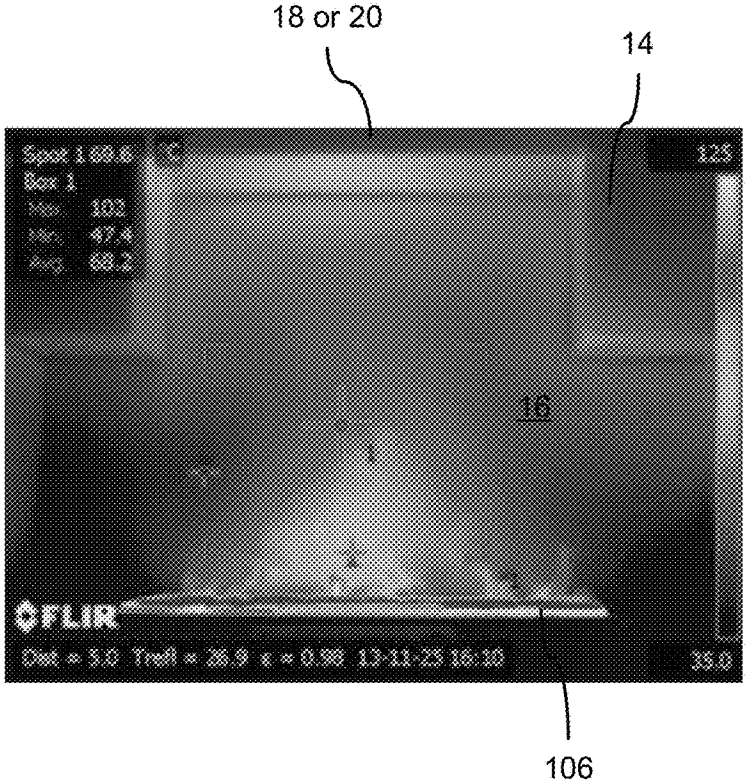
FIG. 10B is a schematic view illustrating test results of measured temperatures on a back wall and adjacent cabinetry of a kitchen over an unoccupied cooking surface of a home cooking appliance according to an exemplary embodiment of the invention.
Figure 10A:
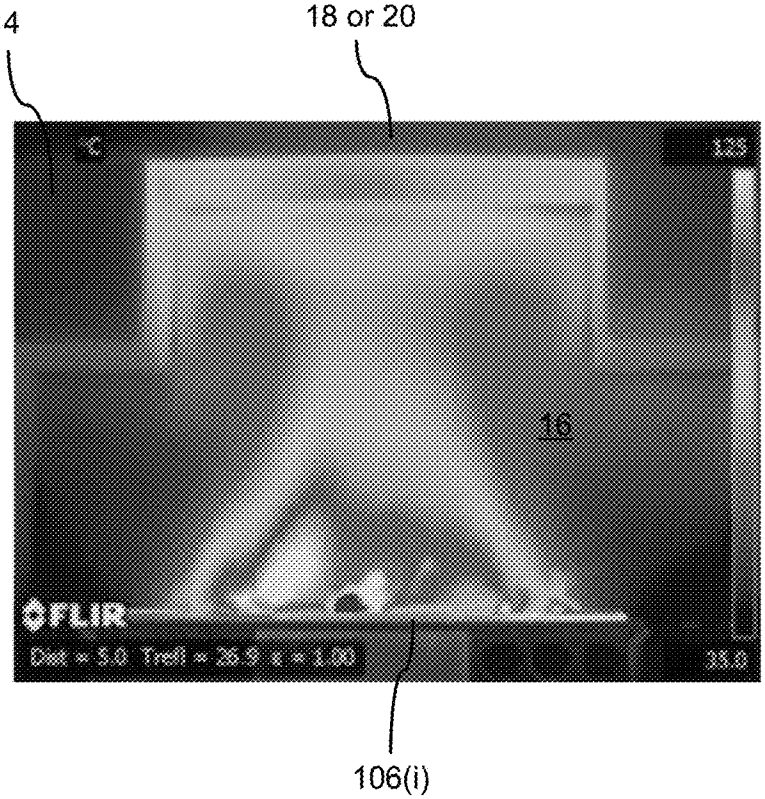
FIG. 10A (CONVENTIONAL ART)
FIG. 10A is a schematic view illustrating test results of measured temperatures on a back wall and adjacent cabinetry of a kitchen over an unoccupied cooking surface of a conventional home cooking appliance.
Figure 10D:
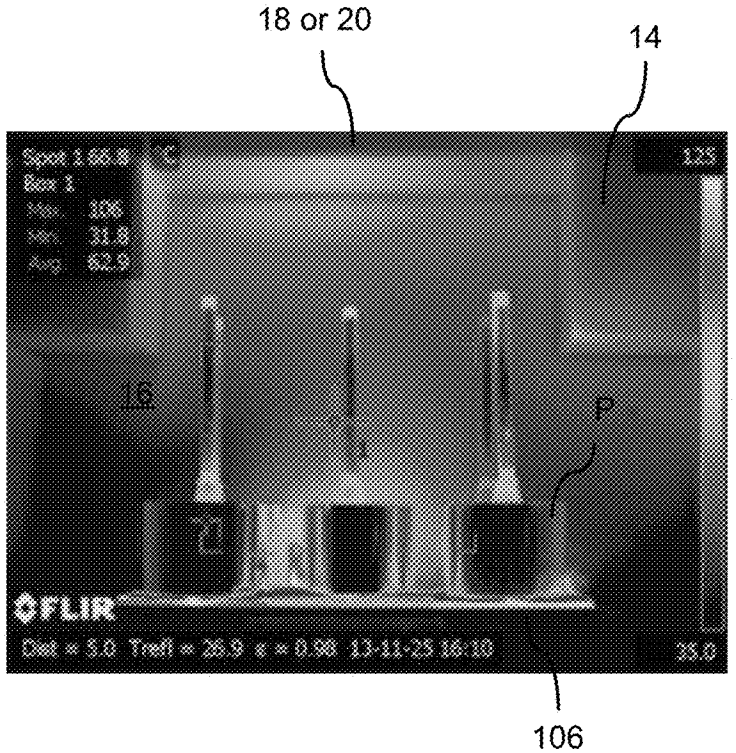
FIG. 10D is a schematic view illustrating test results of measured temperatures on a back wall and adjacent cabinetry of a kitchen over an occupied cooking surface of a home cooking appliance according to an exemplary embodiment of the invention.
Figure 10C:
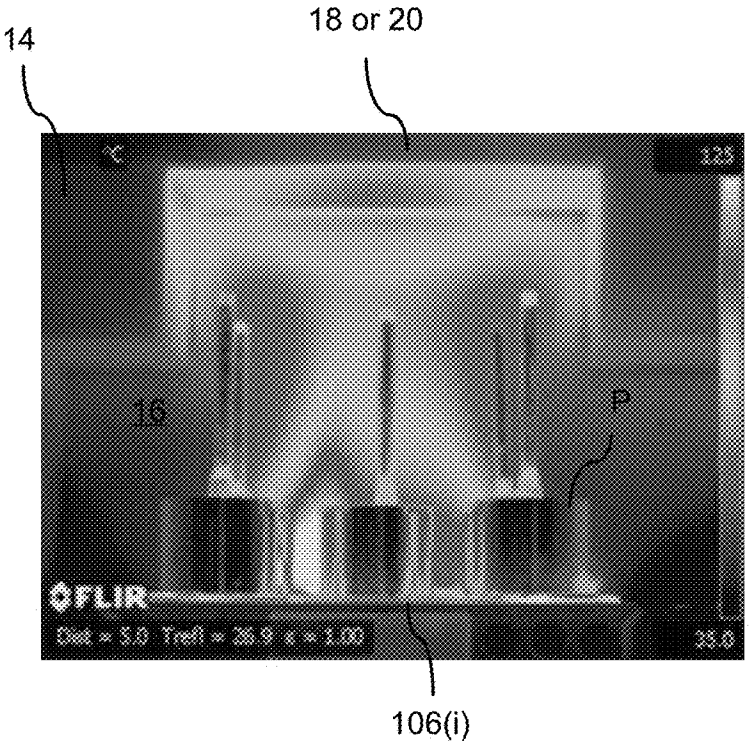
FIG. 10C (CONVENTIONAL ART)
FIG. 10C is a schematic view illustrating test results of measured temperatures on a back wall and adjacent cabinetry of a kitchen over an occupied cooking surface of a conventional home cooking appliance.

Particularly, FIGS. 10A and 10C illustrate thermal imaging of a cooking area above a cooking surface 106(*i*) of a conventional appliance along with the back wall 16 and cabinetry (e.g., 14, 18, 20) of a kitchen. FIG. 10C illustrates special heat-sink pots P with water used for testing purposes. For testing purposes, the conventional appliance was operated with the burners on 80% of full power and the oven was operated for an hour. As shown in FIGS. 10A and 10C, the tests resulted in potentially dangerously high temperatures at the back wall 16 and over-the-range cabinetry (e.g., 14, 18, 20), which may exceed prescribed acceptable limits for industry standards and regulations.

In comparison, FIGS. 10B and 10D illustrate thermal imaging showing a cooking area of an exemplary appliance (e.g., 100 in FIG. 1) having the features of the flue boundary 150, cooling rough-in box 170, and the rear vent trim 120 according to the present invention, along with the back wall 14 and cabinetry (e.g., 14, 18, 20) of a kitchen. For testing purposes, the exemplary appliance also was operated with the burners on 80% of full power and the oven was operated for an hour. FIG. 10D illustrates special heat-sink pots P with water used for testing purposes of the exemplary appliance. As shown in FIGS. 10B and 10D, the tests resulted in a significant reduction in temperatures at the back wall 14 and over-the-range cabinetry (e.g., 14, 18, 20) compared to the conventional appliance. As a result, the exemplary appliance was able to maintain temperatures below the prescribed limits for industry standards and regulations.

Figure 11B:
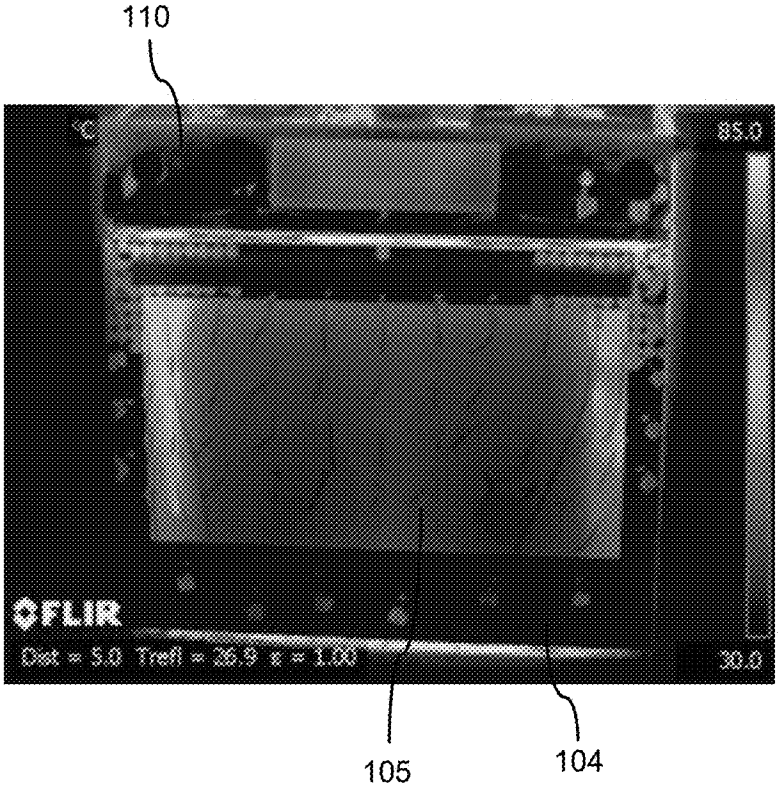
FIG. 11B is a schematic view illustrating test results of measured temperatures on a door of a home cooking appliance according to an exemplary embodiment of the invention.
Figure 11A:
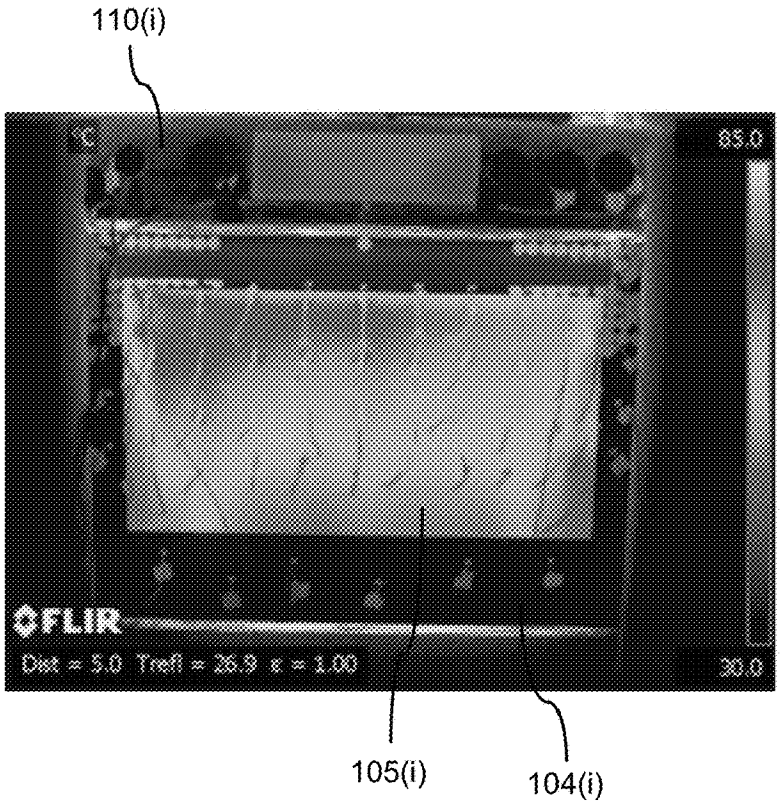
FIG. 11A (CONVENTIONAL ART)
FIG. 11A is a schematic view illustrating test results of measured temperatures on a door of a conventional home cooking appliance.

FIGS. 11A and 11B illustrate thermal imaging showing a comparison between a glass oven door 104(*i*) of a conventional appliance and a glass oven door 104 of an exemplary appliance having the features of the present invention. The thermal imaging illustrates higher temperatures using lighter shades, and illustrates lower temperatures in darker shades. The thermal imaging has been annotated to identify the features of the appliance and the surrounding environment of the kitchen.

Particularly, FIG. 11A illustrates thermal imaging of a glass oven door 104(*i*) having door glass 105(*i*) of a conventional appliance where a self-clean cycle of the oven was performed. As shown in FIG. 11A, the tests resulted in potentially dangerously high temperatures at the glass oven door 104(*i*) and door glass 105(*i*), which may exceed prescribed acceptable limits for industry standards and regulations.

In comparison, FIG. 11B illustrates thermal imaging showing a glass oven door 104 having door glass 105 of an exemplary appliance having the features of the flue boundary 150, cooling rough-in box 170, and the rear vent trim 120 according to the present invention where a self-clean cycle of the oven was performed. As shown in FIG. 11B, the tests resulted in a significant reduction in temperatures at the glass oven door 104 and the door glass 105 compared to the conventional appliance. As a result, the exemplary appliance was able to maintain temperatures below the prescribed limits for industry standards and regulations.

With reference again to FIGS. 1-11B, the flue boundary 150, the cooling rough-in box 170, and/or the rear vent trim 120, either alone or arranged in combination, enable the exemplary embodiments of the appliance 100 to minimize wall temperatures and component temperatures, while maintaining passing combustion results, for example, at the burners 108 and cooking compartment 190 (FIG. 7). More particularly, in testing, an exemplary appliance 100 including the flue boundary 150, the cooling rough-in box 170, and/or the rear vent trim 120 maintained good combustion within the cooking compartment while reducing back wall temperatures, for example, by as much 30-60° C. and glass oven door temperatures by as much 30° C., when the features of the flue boundary 150, the cooling rough-in box 170, and the rear vent trim 120 are combined. The exemplary embodiments provide important advantages in that an appliance having the flue boundary 150, the cooling rough-in box 170, and/or the rear vent trim 120 can be configured to be ready to be pushed up against any composition back wall 16 as-is such that a user can install the appliance 100 with minimal or no clearance to a combustible wall 16 and/or under an over-the-range cabinet 18 or component 20, such as an OTR microwave, without any required modifications to the kitchen cabinets, back wall, or countertops. The flue boundary 150, the cooling rough-in box 170, and the rear vent trim 120, both individually and in combination, operate to manage and control the flow of hot air to minimize temperatures at the back wall 16 as well as at the glass oven door 104, door glass 105, and electronic controls of the appliance 100.

Other advantages of the exemplary flue boundary 150, the cooling rough-in box 170, and/or the rear vent trim 120 are that the exemplary arrangement does not blow hot air at a user, allows the burners to function effectively even at lowest settings (without nuisance clicking), allows installation of the appliance with an OTR component (such as an OTR microwave), allows installation of the appliance with a combustible rear wall, and maintains safe door temperatures and electronic component temperatures, even during self clean cycles, particularly when used in combination with other temperature control measures of the exemplary home cooking appliance 100. By effectively managing and controlling the flow of hot air (e.g., flue gas, cooling air, etc.), the exemplary appliance 100 having the flue boundary 150, the cooling rough-in box 170, and/or the rear vent trim 120 can assist with balancing and optimizing the air flow in the cooking compartment, thereby resulting in improved baking results for the oven. Moreover, by effectively managing and controlling the flow of hot air, the exemplary appliance having the flue boundary 150, the cooling rough-in box 170, and/or the rear vent trim 120 enables the use of a low-profile rear vent trim (e.g., 120) having a flush installation with the cooking surface 106 to be used with a high power cooktop (e.g., 60000 BTU/Hr) while complying with industry standards and regulations.

With reference again to FIGS. 1-11B, another exemplary embodiment is directed to a home cooking appliance 100 comprising a housing 102, a cooking compartment 190 in the housing 102 and accessible through a door 104 in a front of the housing 102; a flue 156, 158 in the housing 102 and in fluid communication with the cooking compartment 190 for exhausting flue gases A3 from the cooking compartment 190; an exhaust outlet 132, 134 for exhausting the flue gases A3 from the housing 120; and a flue boundary 150 connecting the flue 156, 158 and the exhaust outlet 132, 134, the flue boundary 150 separating the flue gases A3 from cooling air (e.g., A1) flowing through the housing 102 and preventing dilution of the flue gases A3 with the cooling air (e.g., A1).

With reference again to FIGS. 1-11B, another exemplary embodiment is directed to a home cooking appliance 100 comprising a housing 102, a cooking compartment 190 in the housing 102 and accessible through a door 104 in a front of the housing 102; a flue 156, 158 in the housing 102 and in fluid communication with the cooking compartment 190 for exhausting flue gases A3 from the cooking compartment 190; an exhaust outlet 132, 134 for exhausting the flue gases A3 from the housing 120; first means (e.g., opening defined by walls 152/152A, 154, and 164) for connecting the flue 156, 158 and the exhaust outlet 132, 134, for separating the flue gases A3 from cooling air (e.g., A1) flowing through the housing 102, and for preventing dilution of the flue gases A3 with the cooling air (e.g., A1); and second means (e.g., 170) for separating a rear wall 152 of the flue boundary 150 from a rear exterior wall 114 of the housing 102, and for cooling a wall (e.g., 152) of the flue boundary 150 with the cooling air (e.g., A1).

The present invention has been described herein in terms of several preferred embodiments. However, modifications and additions to these embodiments will become apparent to those of ordinary skill in the art upon a reading of the foregoing description. It is intended that all such modifications and additions comprise a part of the present invention to the extent that they fall within the scope of the several claims appended hereto.

What is claimed is:

1. A home cooking appliance comprising:

a housing;

a cooking surface on a top of the housing;

a cooking compartment in the housing and accessible through a door in a front of the housing;

a flue in the housing and in fluid communication with the cooking compartment for exhausting flue gases from the cooking compartment;

an exhaust outlet for exhausting the flue gases from the housing;

a flue boundary connecting the flue and the exhaust outlet, the flue boundary separating the flue gases from cooling air flowing through the housing and preventing dilution of the flue gases with the cooling air, wherein the exhaust outlet comprises a rear vent trim on the top of the housing and at a rear edge of the top of the housing, the rear vent trim having an upper surface that is substantially flush with an upper surface of the cooking surface, the rear vent trim including an opening permitting the flue gases to exit the flue boundary, and wherein the flue boundary exhausts the flue gases from the flue through the opening in the rear vent trim of the exhaust outlet away from a 90° angle with respect to the upper surface of the cooking surface and in a forward direction toward the cooking surface and below the cooking surface.

2. The home cooking appliance of claim 1, further comprising:

a second flue in the housing and in fluid communication with the cooking compartment for exhausting flue gases from the cooking compartment;

a second exhaust outlet for exhausting the flue gases from the housing; and a second flue boundary connecting the second flue and the second exhaust outlet, the second flue boundary separating the flue gases from the cooling air flowing through the housing.

3. The home cooking appliance of claim 2, wherein the flue boundary and the second flue boundary each exhausts the flue gases forward away from the 90° angle with respect to the upper surface of the cooking surface.

4. The home cooking appliance of claim 3, wherein the flue boundary and the second flue boundary each exhausts the flue gases forward away from the 90° angle with respect to the upper surface of the cooking surface and below the cooking surface.

5. The home cooking appliance of claim 1, wherein the flue boundary comprises:

a sealed cavity having an inlet and an outlet, wherein the inlet is in fluid communication with the flue and the outlet is in fluid communication with the exhaust outlet.

6. The home cooking appliance of claim 5, wherein the inlet includes an opening in a lower surface of the flue boundary, and wherein the flue boundary is disposed on top of the flue such that the flue gas flows from the flue into the flue boundary via the opening in the lower surface.

7. The home cooking appliance of claim 5, wherein the outlet is formed in an upper part of the flue boundary, and wherein the flue boundary is disposed below the exhaust outlet.

8. The home cooking appliance of claim 5, wherein the sealed cavity includes a rear wall having an angled section at an upper end of the rear wall, and wherein the angled section directs the flue gases forward away from the 90° angle with respect to the upper surface of the cooking surface and exhausts the flue gases through the exhaust outlet in the forward direction toward the cooking surface.

9. The home cooking appliance of claim 8, wherein the rear wall includes a lower section disposed below the angled section, and wherein the lower section includes a substantially vertical wall.

10. The home cooking appliance of claim 1, wherein the flue boundary includes a deflector that directs the flue gases forward away from the 90° angle with respect to the upper surface of the cooking surface and exhausts the flue gases through the opening in the rear vent trim of the exhaust outlet in the forward direction at least partially onto the upper surface of the cooking surface or at least partially below the upper surface of the cooking surface.

11. The home cooking appliance of claim 5, wherein an area of the sealed cavity at an inlet end is greater than an area of the sealed cavity at an outlet end.

12. The home cooking appliance of claim 6, wherein an area of the sealed cavity at an inlet end is greater than an area of the sealed cavity at an outlet end, and wherein the lower surface has an area larger than the opening in the lower surface.

13. The home cooking appliance of claim 8, wherein the sealed cavity includes a front wall that is opposed to the rear wall, and wherein an upper end of the front wall is closer to the rear wall of the sealed cavity than a lower end of the front wall.

14. The home cooking appliance of claim 8, wherein the housing includes a rear exterior wall, and wherein the rear wall of the sealed cavity is spaced apart from the rear exterior wall of the housing.

15. The home cooking appliance of claim 1, wherein the flue boundary has a rear wall separating the flue gases from the cooling air flowing through the housing and preventing dilution of the flue gases with the cooling air, wherein the housing includes a rear exterior wall, and wherein the rear wall of the flue boundary is spaced apart from the rear exterior wall of the housing.

16. The home cooking appliance of claim 15, wherein the rear exterior wall of the housing and the rear wall of the flue boundary cooperate to form a cooling air flow channel in fluid communication with a second exhaust outlet of the housing, and wherein the cooling air flow channel is isolated from the flue gases and prevents dilution of the flue gases with cooling air.

17. The home cooking appliance of claim 15, wherein the rear exterior wall of the housing includes an opening permitting the cooling air to be drawn into the cooling air flow channel from an exterior of the housing.

18. The home cooking appliance of claim 1, further comprising:

a cooling rough-in box at a rear of the housing, the cooling rough-in box having a cooling air flow channel extending along a rear wall of the flue boundary for cooling the rear wall of the flue boundary with the cooling air, wherein the cooling rough-in box includes a surface having an opening permitting the cooling air to be drawn into the cooling air flow channel from an exterior of the housing by convection owing to heat on the rear wall of the flue boundary.

19. The home cooking appliance of claim 1, wherein at least one of the exhaust outlet or the flue boundary directs the flue gases from the flue through the opening in the rear vent trim away from the 90° angle with respect to the upper surface of the cooking surface and in the forward direction at least partially onto the upper surface of the cooking surface or at least partially below the upper surface of the cooking surface.

20. The home cooking appliance of claim 18, wherein the flue boundary exhausts the flue gases away from the 90° angle with respect to the upper surface of the cooking surface, wherein the rear vent trim includes a second opening permitting the cooling air in the cooling air flow channel to exit the cooling rough-in box, and wherein the rear vent trim directs the cooling air forward and away from the 90° angle with respect to the upper surface of the cooking surface.

21. A home cooking appliance comprising:

a housing;

a cooking surface on a top of the housing;

a cooking compartment in the housing and accessible through a door in a front of the housing;

a flue in the housing and in fluid communication with the cooking compartment for exhausting flue gases from the cooking compartment;

an exhaust outlet for exhausting the flue gases from the housing;

first means for connecting the flue and the exhaust outlet, for separating the flue gases from cooling air flowing through the housing, and for preventing dilution of the flue gases with the cooling air; and second means for spacing a rear wall of the flue boundary from a rear exterior wall of the housing, and for cooling a wall of the flue boundary with the cooling air, wherein the exhaust outlet comprises a rear vent trim on the top of the housing and at a rear edge of the top of the housing, the rear vent trim having an upper surface that is substantially flush with an upper surface of the cooking surface, the rear vent trim including an opening permitting the flue gases to exit the exhaust outlet, and wherein the first means exhausts the flue gases from the flue through the opening in the rear vent trim of the exhaust outlet away from a 90° angle with respect to the upper surface of the cooking surface and in a forward direction toward the cooking surface and below the cooking surface.

22. A home cooking appliance comprising:

a housing;

a cooking surface on a top of the housing;

a cooking compartment in the housing and accessible through a door in a front of the housing;

a flue in the housing and in fluid communication with the cooking compartment for exhausting flue gases from the cooking compartment;

an exhaust outlet for exhausting the flue gases from the housing;

a flue boundary connecting the flue and the exhaust outlet, the flue boundary separating the flue gases from cooling air flowing through the housing and preventing dilution of the flue gases with the cooling air, wherein the exhaust outlet comprises a rear vent trim on the top of the housing and at a rear edge of the top of the housing, the rear vent trim having an upper surface that is substantially flush with an upper surface of the cooking surface, the rear vent trim including an opening permitting the flue gases to exit the flue boundary, wherein the flue boundary exhausts the flue gases from the flue through the opening in the rear vent trim of the exhaust outlet away from a 90° angle with respect to the upper surface of the cooking surface and in a forward direction toward the cooking surface, wherein the cooking surface includes a cooking grate, and wherein the flue boundary directs the flue gases exiting the exhaust outlet through the opening in the rear vent trim such that the flue gases are exhausted from the exhaust outlet in a forward direction and below the cooking grate.

23. The home cooking appliance of claim 22, wherein the rear vent trim includes a second opening permitting additional air to exit from within the rear vent trim, and wherein the second opening permits the additional air to exhaust from the rear vent trim above the cooking grate.

24. A home cooking appliance comprising:

a housing;

a cooking surface on a top of the housing, wherein the cooking surface includes a cooking grate;

a cooking compartment in the housing and accessible through a door in a front of the housing;

a flue in the housing and in fluid communication with the cooking compartment for exhausting flue gases from the cooking compartment;

an exhaust outlet for exhausting the flue gases from the housing; and a flue boundary connecting the flue and the exhaust outlet, the flue boundary separating the flue gases from cooling air flowing through the housing and preventing dilution of the flue gases with the cooling air, wherein the exhaust outlet comprises a rear vent trim on the top of the housing and at a rear edge of the top of the housing, the rear vent trim having an upper surface that is substantially flush with an upper surface of the cooking surface, the rear vent trim including an opening permitting the flue gases to exit the flue boundary, wherein the flue boundary includes a deflector that directs the flue gases exiting the exhaust outlet through the opening in the rear vent trim in a forward direction and below the cooking grate, wherein the rear vent trim includes a second opening permitting additional air to exit from within the rear vent trim, wherein the second opening permits the additional air to exhaust from the rear vent trim above the cooking grate, and wherein the rear vent trim includes a deflector that directs the additional air through the second opening in the rear vent trim in a direction above the cooking grate.

25. The home cooking appliance of claim 22, further comprising:

a cooling rough-in box at a rear of the housing, the cooling rough-in box having a cooling air flow channel extending along a rear wall of the flue boundary for cooling the rear wall of the flue boundary with the cooling air, wherein the cooling rough-in box includes a surface having an opening permitting the cooling air to be drawn into the cooling air flow channel from an exterior of the housing by convection owing to heat on the rear wall of the flue boundary, wherein the rear vent trim includes a second opening permitting the cooling air to exit the cooling rough-in box, and wherein the second opening permits the cooling air to exhaust from the rear vent trim above the cooking grate.

26. The home cooking appliance of claim 1, wherein the flue boundary is disposed on top of the flue at a flue outlet such that the flue gas flows from the flue outlet into the flue boundary via an opening in a lower surface of the flue boundary, wherein an area of the opening in the lower surface is less than an area of the lower surface, and wherein an area of the flue boundary at an inlet end is greater than an area of the flue boundary at an outlet end to reduce a back pressure at the flue outlet.

27. The home cooking appliance of claim 21, wherein the first means is disposed on top of the flue at a flue outlet such that the flue gas flows from the flue outlet into the first means, and wherein an area of the first means at an inlet end is greater than an area of the first means at an outlet end for reducing a back pressure at the flue outlet.

28. The home cooking appliance of claim 1, wherein the rear vent trim includes a second opening permitting additional air to exit from within the rear vent trim, and wherein the second opening permits the additional air to exhaust from the rear vent trim above the upper surface of the cooking surface.

29. The home cooking appliance of claim 22, further comprising:

a second flue in the housing and in fluid communication with the cooking compartment for exhausting flue gases from the cooking compartment;

a second exhaust outlet for exhausting the flue gases from the housing; and a second flue boundary connecting the second flue and the second exhaust outlet, the second flue boundary separating the flue gases from the cooling air flowing through the housing, wherein the second flue boundary exhausts the flue gases forward away from the 90° angle with respect to the upper surface of the cooking grate and below the cooking grate.

30. The home cooking appliance of claim 22, wherein the flue boundary comprises:

a sealed cavity having an inlet and an outlet, wherein the inlet is in fluid communication with the flue and the outlet is in fluid communication with the exhaust outlet.

31. The home cooking appliance of claim 30, wherein the inlet includes an opening in a lower surface of the flue boundary, and wherein the flue boundary is disposed on top of the flue such that the flue gas flows from the flue into the flue boundary via the opening in the lower surface.

32. The home cooking appliance of claim 30, wherein the sealed cavity includes a rear wall having an angled section at an upper end of the rear wall, and wherein the angled section directs the flue gases forward away from the 90° angle with respect to the upper surface of the cooking grate and exhausts the flue gases through the exhaust outlet in the forward direction toward the cooking grate.

33. The home cooking appliance of claim 22, wherein the flue boundary includes a deflector.

34. The home cooking appliance of claim 22, wherein the flue boundary has a rear wall separating the flue gases from the cooling air flowing through the housing and preventing dilution of the flue gases with the cooling air, wherein the housing includes a rear exterior wall, and wherein the rear wall of the flue boundary is spaced apart from the rear exterior wall of the housing.

35. The home cooking appliance of claim 34, wherein the rear exterior wall of the housing and the rear wall of the flue boundary cooperate to form a cooling air flow channel in fluid communication with a second exhaust outlet of the housing, and wherein the cooling air flow channel is isolated from the flue gases and prevents dilution of the flue gases with cooling air.

* * * * *